US007839381B2

(12) United States Patent
Zhou et al.

(10) Patent No.: US 7,839,381 B2
(45) Date of Patent: Nov. 23, 2010

(54) DRIVING METHOD FOR AN ELECTROPHORETIC DISPLAY WITH ACCURATE GREYSCALE AND MINIMIZED AVERAGE POWER CONSUMPTION

(75) Inventors: Guofu Zhou, Best (NL); Alex V. Henzen, Landgraaf (NL); Jan van de Kamer, Heerlen (NL); Mark T. Johnson, Veldhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 781 days.

(21) Appl. No.: 10/570,844

(22) PCT Filed: Aug. 30, 2004

(86) PCT No.: PCT/IB2004/051610

§ 371 (c)(1),
(2), (4) Date: Mar. 6, 2006

(87) PCT Pub. No.: WO2005/024770

PCT Pub. Date: Mar. 17, 2005

(65) Prior Publication Data

US 2006/0262083 A1 Nov. 23, 2006

Related U.S. Application Data

(60) Provisional application No. 60/501,126, filed on Sep. 8, 2003, provisional application No. 60/545,438, filed on Feb. 18, 2004.

(51) Int. Cl.
*G09G 3/34* (2006.01)

(52) U.S. Cl. ..... 345/107; 345/87; 345/98; 359/296

(58) Field of Classification Search ..... 345/107, 345/211, 212, 691–693, 98; 713/320
See application file for complete search history.

(56) References Cited

U.S. PATENT DOCUMENTS 5,961,804 A 10/1999 Jacobson et al.

(Continued)

FOREIGN PATENT DOCUMENTS

EP 0186519 A2 7/1986

(Continued)

OTHER PUBLICATIONS

Hattori et al, "A Novel Bistable Reflective Display Using Quick-response Liquid Powder" Journal of the SID International Symposium Seminar, May 2003, Revised 2004.

*Primary Examiner*—Richard Hjerpe
*Assistant Examiner*—Jeffrey Steinberg

(57) ABSTRACT

An image is updated on a bi-stable display (310) such as an electrophoretic display in successive frame periods by accessing data defining a set of voltage waveforms for the successive frame periods. At least a portion of the bi-stable display is driven during the successive frame periods according to the accessed data so that a longer frame period (FT, 1302, 1304, 1402, 1502, 1602, 1702, 1802) is used during at least a first portion of the voltage waveforms, and a shorter frame period (FT') is used during at least a second portion of the voltage waveforms. For example, the longer frame period may be an elongated frame period, which is the longest period during which each of the voltage waveforms has a respective constant voltage value.

21 Claims, 19 Drawing Sheets

U.S. PATENT DOCUMENTS

| | | | | |
|---|---|---|---|---|
| 6,120,839 | A | 9/2000 | Comiskey et al. | |
| 6,130,774 | A | 10/2000 | Albert et al. | |
| 6,531,997 | B1 * | 3/2003 | Gates et al. | 345/107 |
| 6,822,782 | B2 * | 11/2004 | Honeyman et al. | 359/296 |
| 6,850,217 | B2 * | 2/2005 | Huang et al. | 345/97 |
| 6,975,313 | B2 * | 12/2005 | Kurumisawa | 345/212 |
| 7,002,728 | B2 * | 2/2006 | Pullen et al. | 359/296 |
| 7,012,600 | B2 * | 3/2006 | Zehner et al. | 345/214 |
| 7,023,409 | B2 * | 4/2006 | Blackson et al. | 345/87 |
| 7,038,651 | B2 * | 5/2006 | Nitta et al. | 345/98 |
| 7,053,412 | B2 * | 5/2006 | Hack et al. | 257/79 |
| 7,230,750 | B2 * | 6/2007 | Whitesides et al. | 359/296 |
| 2006/0139311 | A1 * | 6/2006 | Zehner et al. | 345/107 |
| 2007/0200795 | A1 * | 8/2007 | Whitesides et al. | 345/55 |

FOREIGN PATENT DOCUMENTS

| | | | |
|---|---|---|---|
| WO | WO9953373 | A1 | 10/1999 |
| WO | WO03079323 | A1 | 9/2003 |
| WO | 20040066252 | A1 | 8/2004 |

* cited by examiner

DRIVING METHOD FOR AN ELECTROPHORETIC DISPLAY WITH ACCURATE GREYSCALE AND MINIMIZED AVERAGE POWER CONSUMPTION

CROSS REFERENCE TO RELATED APPLICATION

This application claims the benefit of the filing date U.S. provisional patent application Ser. No. 60/501,126 filed Sep. 8, 2003 and U.S. provisional patent application Ser. No. 60/545,438 filed Feb. 18, 2004 both of which are incorporated herein in whole by reference.

The invention relates generally to electronic reading devices such as electronic books and electronic newspapers and, more particularly, to a method and apparatus for driving a bi-stable display such as an electrophoretic display while minimizing average power consumption.

Recent technological advances have provided "user friendly" electronic reading devices such as e-books that open up many opportunities. For example, electrophoretic displays hold much promise. Such displays have an intrinsic memory behavior and are able to hold an image for a relatively long time without power consumption. Power is consumed only when the display needs to be refreshed or updated with new information. So, the power consumption in such displays is very low, suitable for applications for portable e-reading devices like e-books and e-newspaper. Electrophoresis refers to movement of charged particles in an applied electric field. When electrophoresis occurs in a liquid, the particles move with a velocity determined primarily by the viscous drag experienced by the particles, their charge (either permanent or induced), the dielectric properties of the liquid, and the magnitude of the applied field. An electrophoretic display is a type of bi-stable display, which is a display that substantially holds an image without consuming power after an image update.

For example, international patent application WO 99/53373, published Apr. 9, 1999, by E Ink Corporation, Cambridge, Mass., US, and entitled Full Color Reflective Display With Multichromatic Sub-Pixels, describes such a display device. WO 99/53373 discusses an electronic ink display having two substrates. One is transparent, and the other is provided with electrodes arranged in rows and columns. A display element or pixel is associated with an intersection of a row electrode and column electrode. The display element is coupled to the column electrode using a thin film transistor (TFT), the gate of which is coupled to the row electrode. This arrangement of display elements, TFT transistors, and row and column electrodes together forms an active matrix. Furthermore, the display element comprises a pixel electrode. A row driver selects a row of display elements, and a column or source driver supplies a data signal to the selected row of display elements via the column electrodes and the TFT transistors. The data signals correspond to graphic data to be displayed, such as text or figures.

The electronic ink is provided between the pixel electrode and a common electrode on the transparent substrate. The electronic ink comprises multiple microcapsules of about 10 to 50 microns in diameter. In one approach, each microcapsule has positively charged white particles and negatively charged black particles suspended in a liquid carrier medium or fluid. When a positive voltage is applied to the pixel electrode, the white particles move to a side of the microcapsule directed to the transparent substrate and a viewer will see a white display element. At the same time, the black particles move to the pixel electrode at the opposite side of the microcapsule where they are hidden from the viewer. By applying a negative voltage to the pixel electrode, the black particles move to the common electrode at the side of the microcapsule directed to the transparent substrate and the display element appears dark to the viewer. At the same time, the white particles move to the pixel electrode at the opposite side of the microcapsule where they are hidden from the viewer. When the voltage is removed, the display device remains in the acquired state and thus exhibits a bi-stable character. In another approach, particles are provided in a dyed liquid. For example, black particles may be provided in a white liquid, or white particles may be provided in a black liquid. Or, other colored particles may be provided in different colored liquids, e.g., white particles in blue liquid.

Other fluids such as air may also be used in the medium in which the charged black and white particles move around in an electric field (e.g., Bridgestone SID2003—Symposium on Information Displays. May 18-23, 2003,—digest 20.3). Colored particles may also be used.

To form an electronic display, the electronic ink may be printed onto a sheet of plastic film that is laminated to a layer of circuitry. The circuitry forms a pattern of pixels that can then be controlled by a display driver. Since the microcapsules are suspended in a liquid carrier medium, they can be printed using existing screen-printing processes onto virtually any surface, including glass, plastic, fabric and even paper. Moreover, the use of flexible sheets allows the design of electronic reading devices that approximate the appearance of a conventional book.

However, the power consumed by the electronic display can become unacceptably high, especially with higher frame rates that may be used at higher temperatures, or to increase the number of grey levels or the greyscale accuracy.

The invention addresses the above and other issues by providing a method and apparatus for driving a bi-stable display such as an electrophoretic display while reducing average power consumption, especially with higher frame rates.

In a particular aspect of the invention, a method for updating at least a portion of a bi-stable display in successive frame periods includes accessing data defining at least one voltage waveform for the successive frame periods, and driving the at least a portion of the bi-stable display during the successive frame periods according to the accessed data so that at least one longer frame period is used during at least a first portion of the voltage waveforms, and at least one shorter frame period is used during at least a second portion of the voltage waveforms.

A related electronic reading device and program storage device are also provided.

Figure 5A:
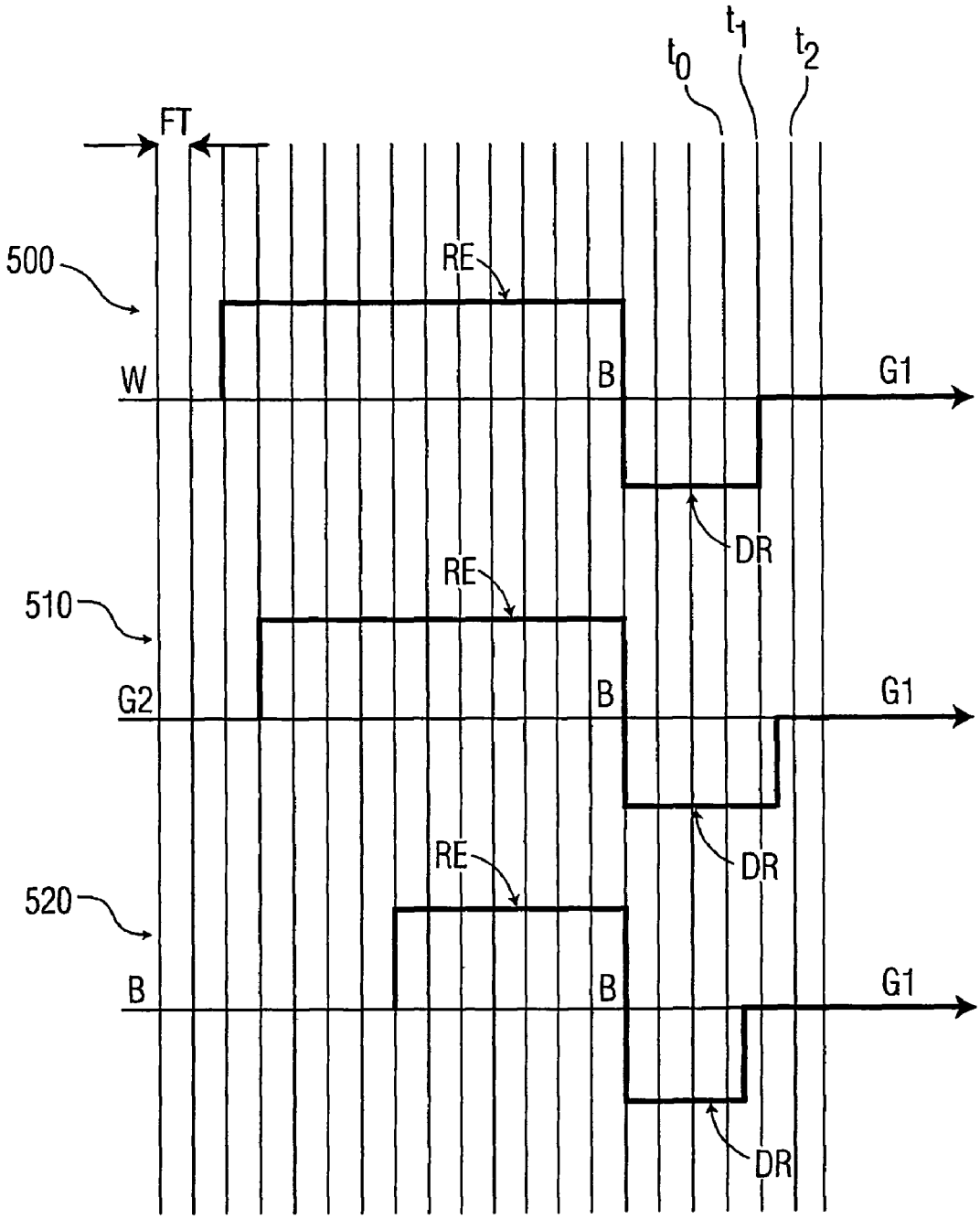
Figure 5B:
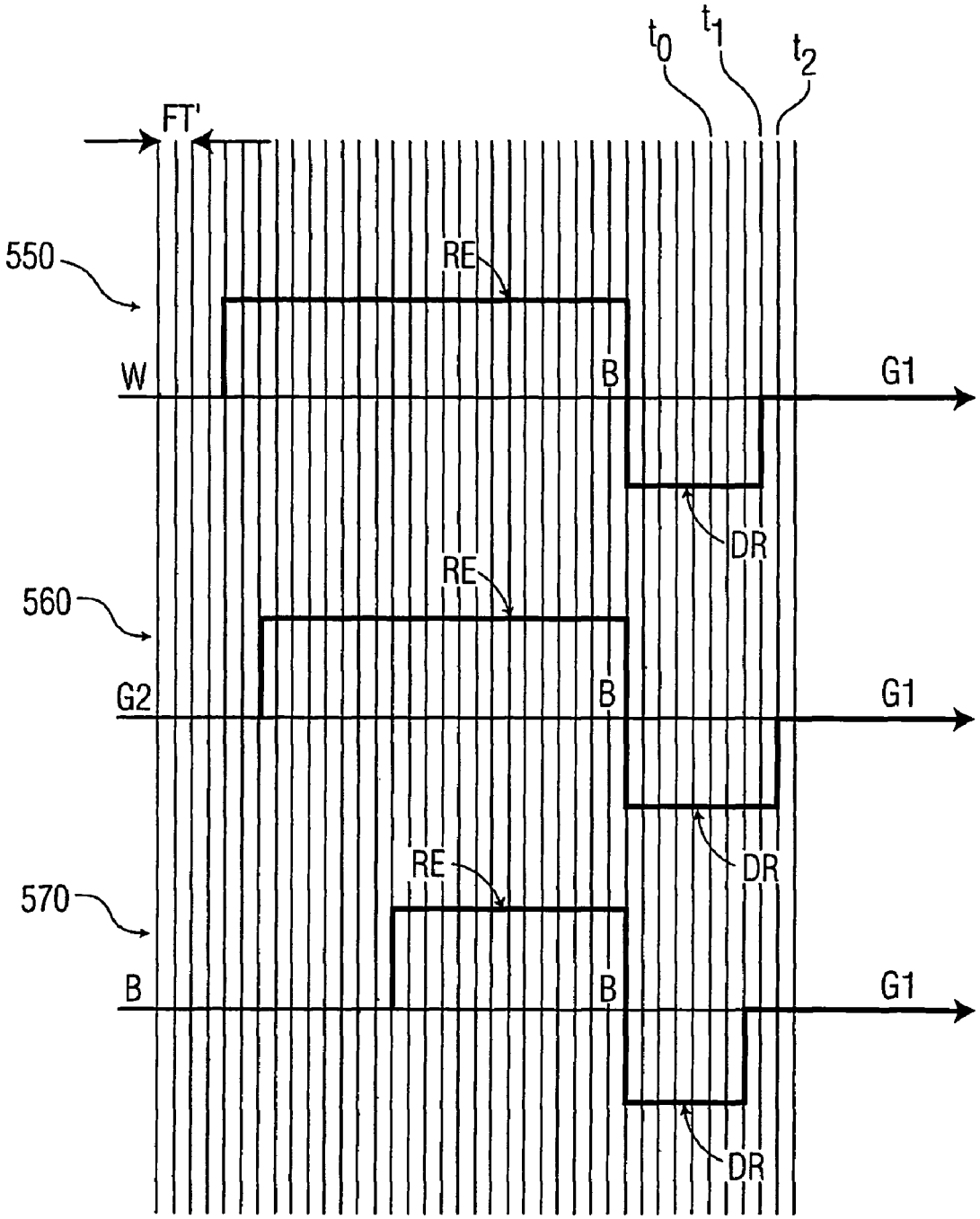
Figure 6:
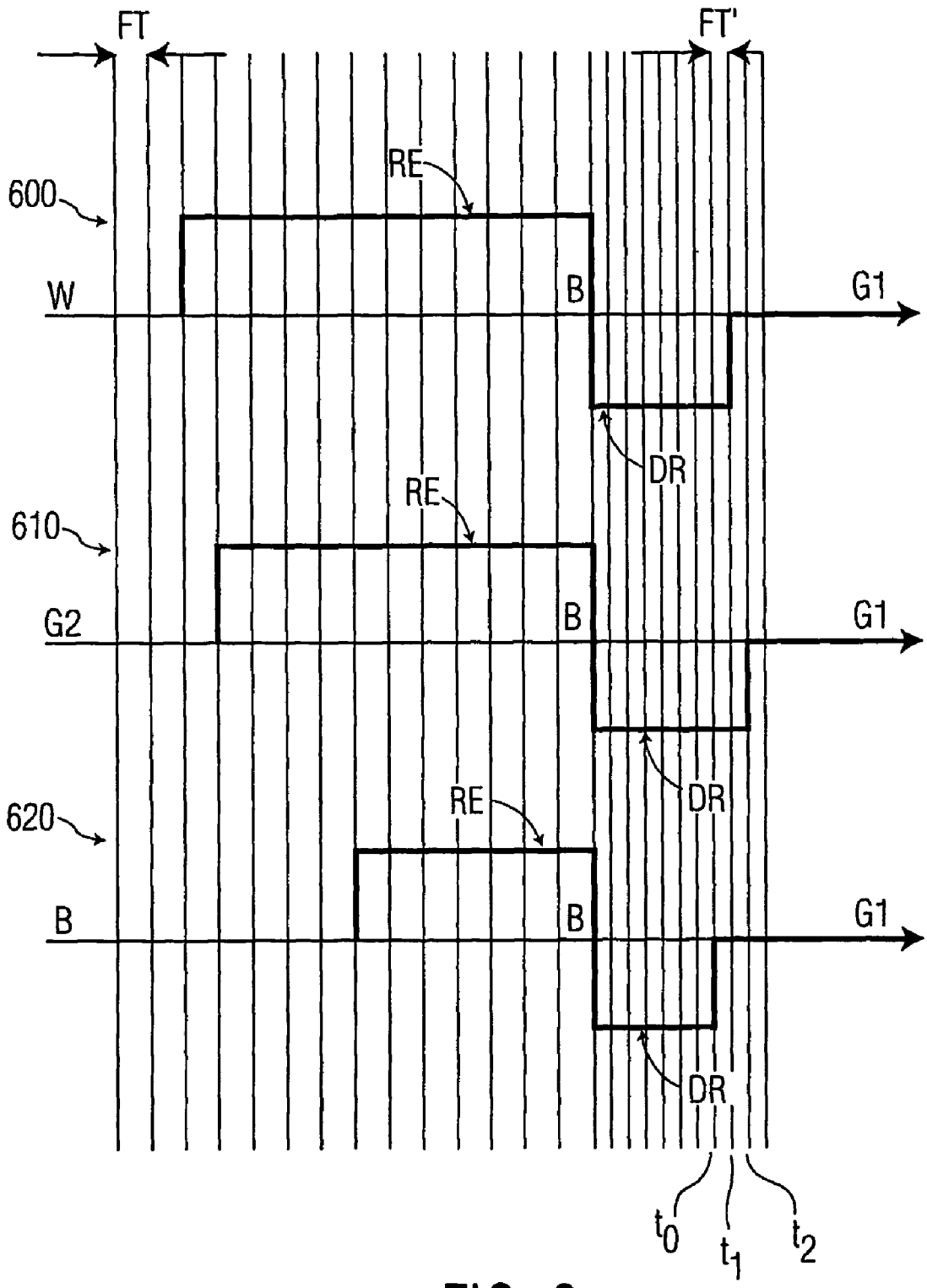
Figure 7:
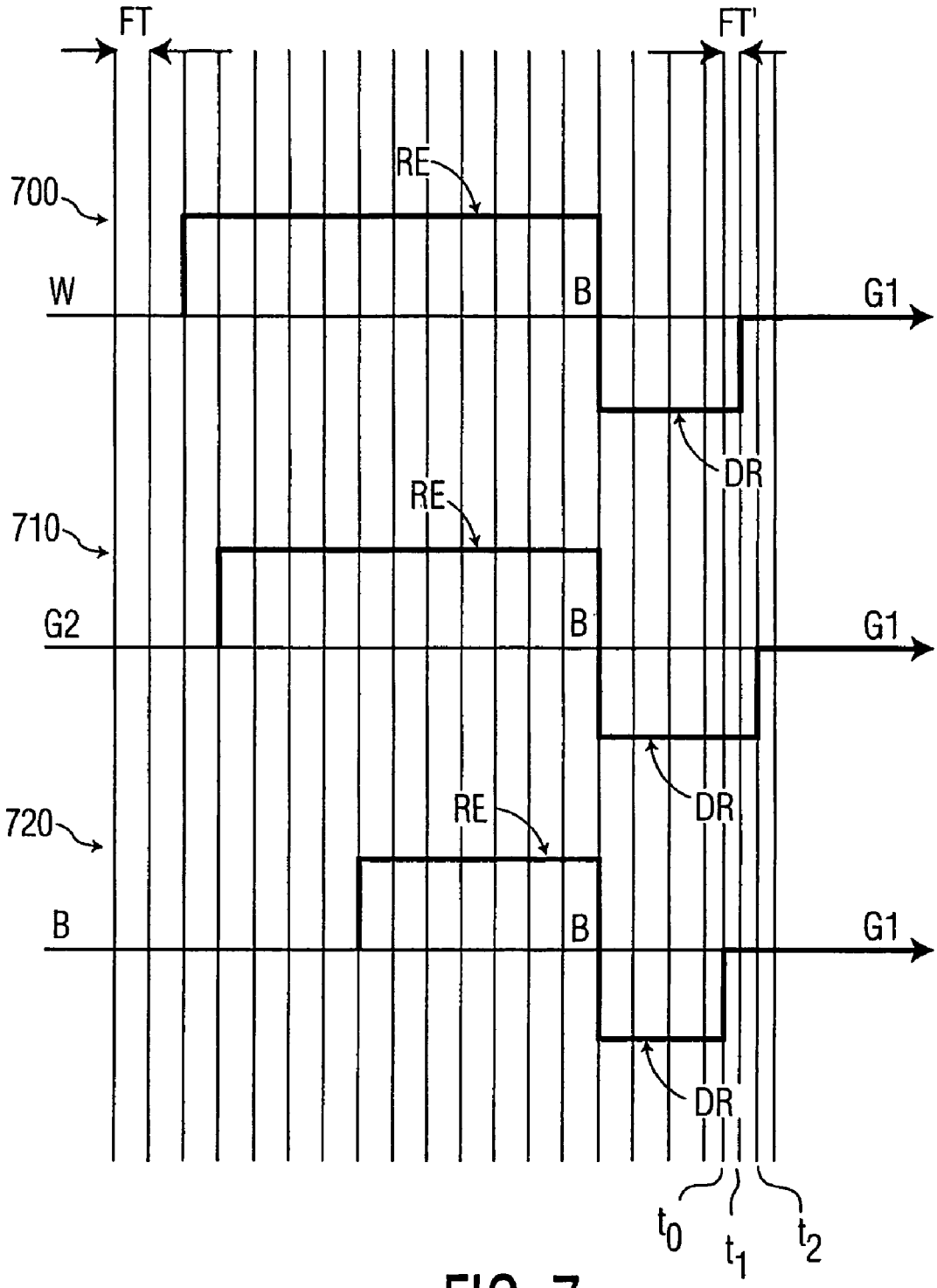
Figure 8:
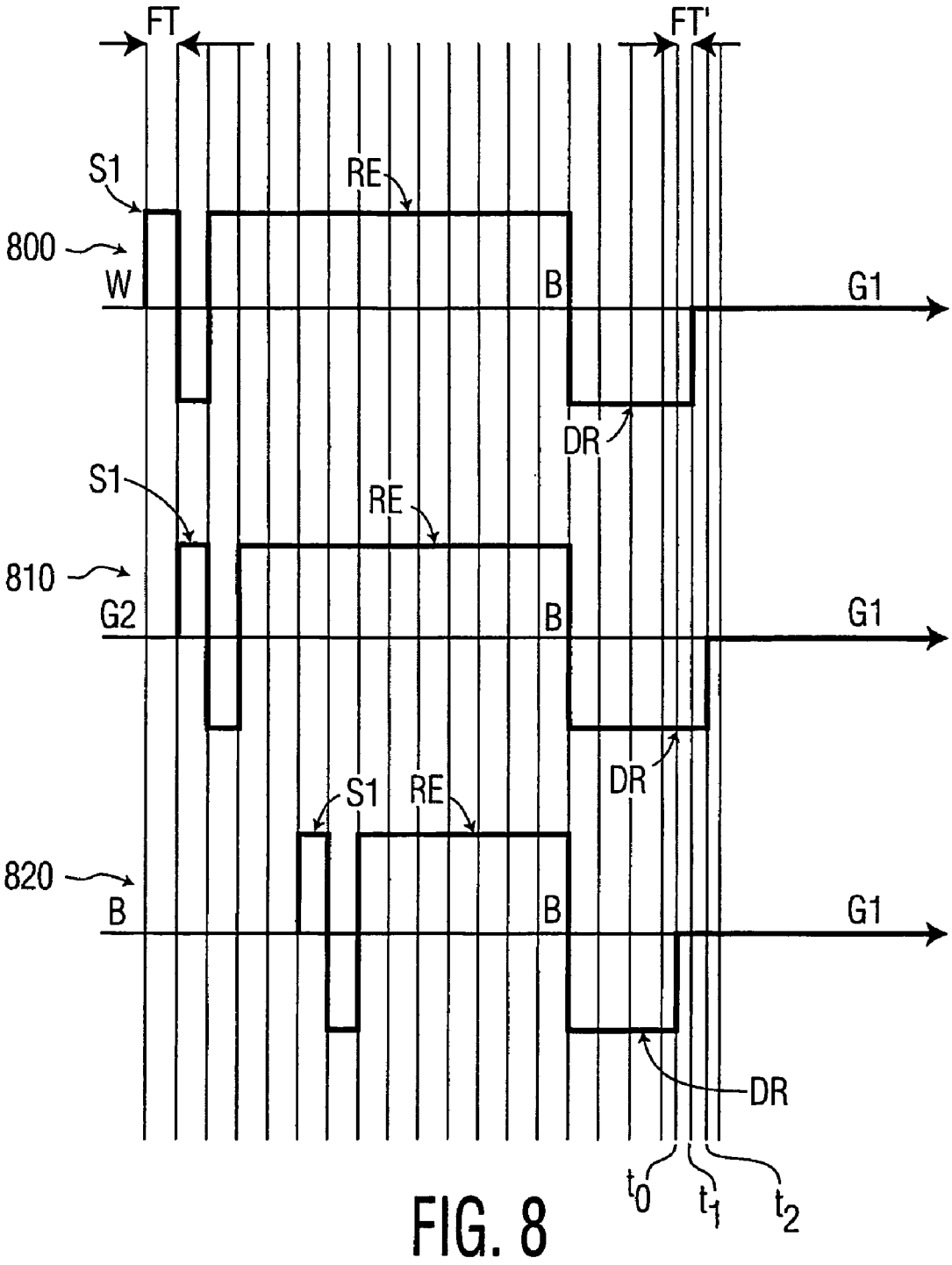
Figure 9:
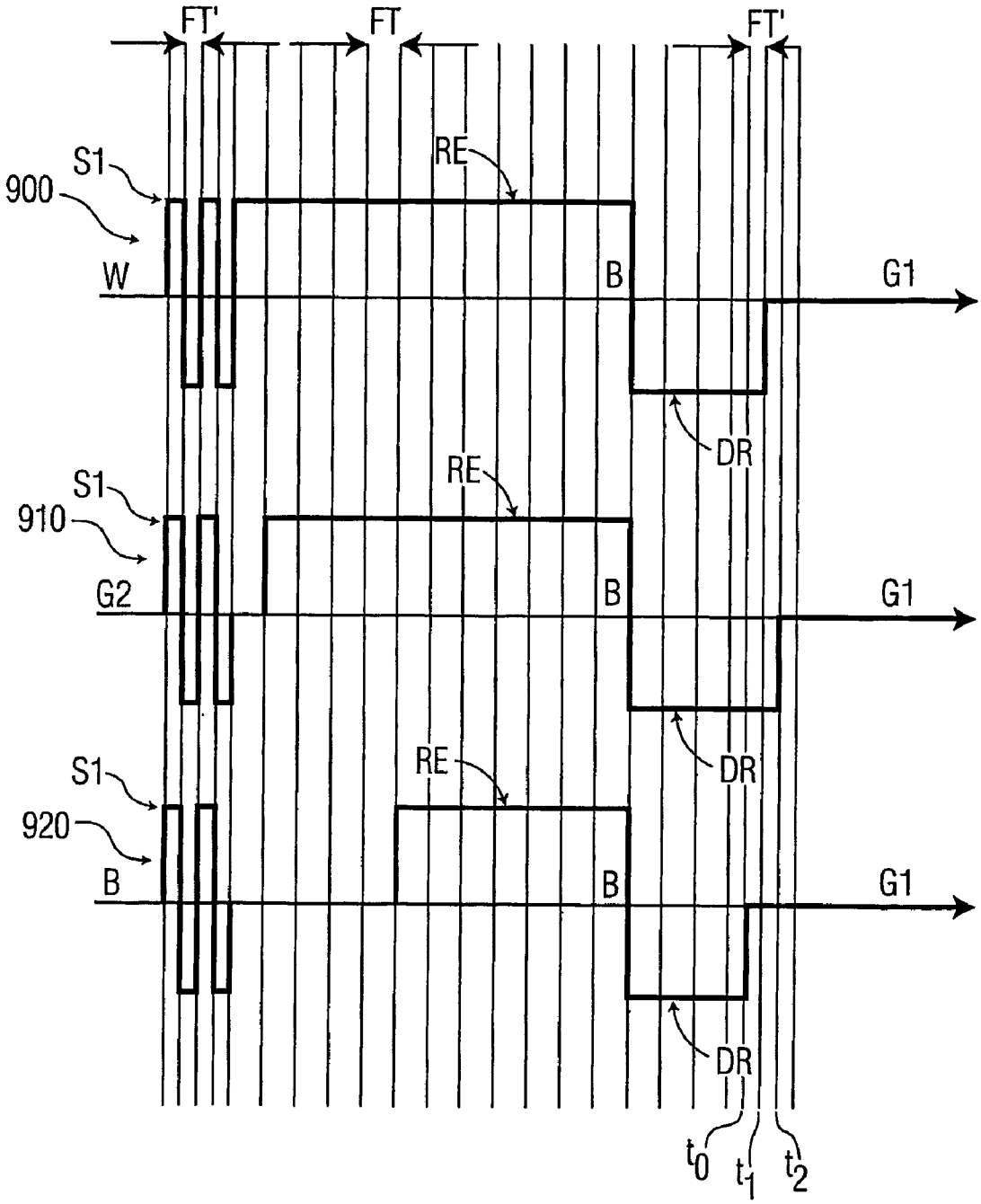
Figure 10:
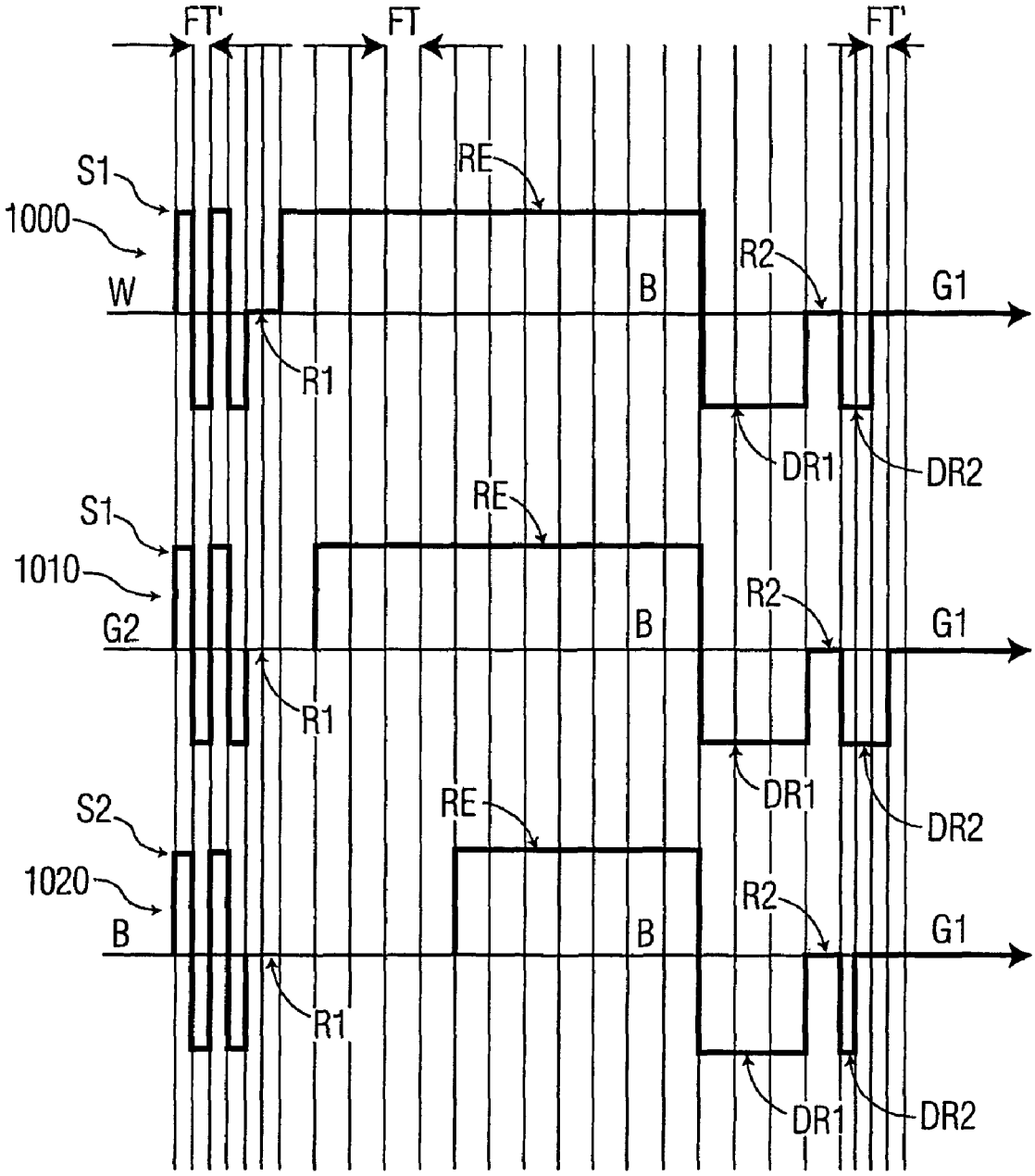
Figure 11A:
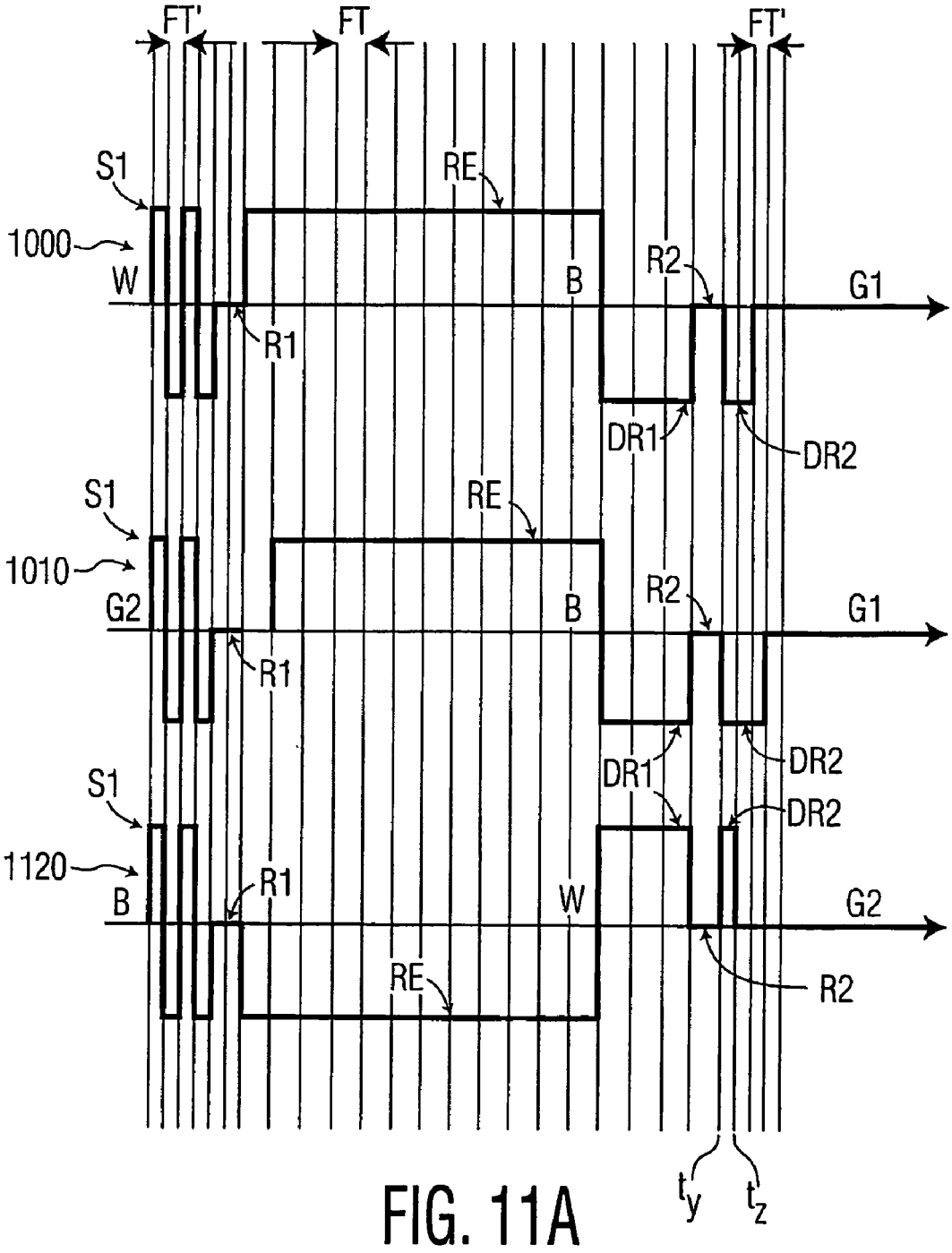
Figure 11B:
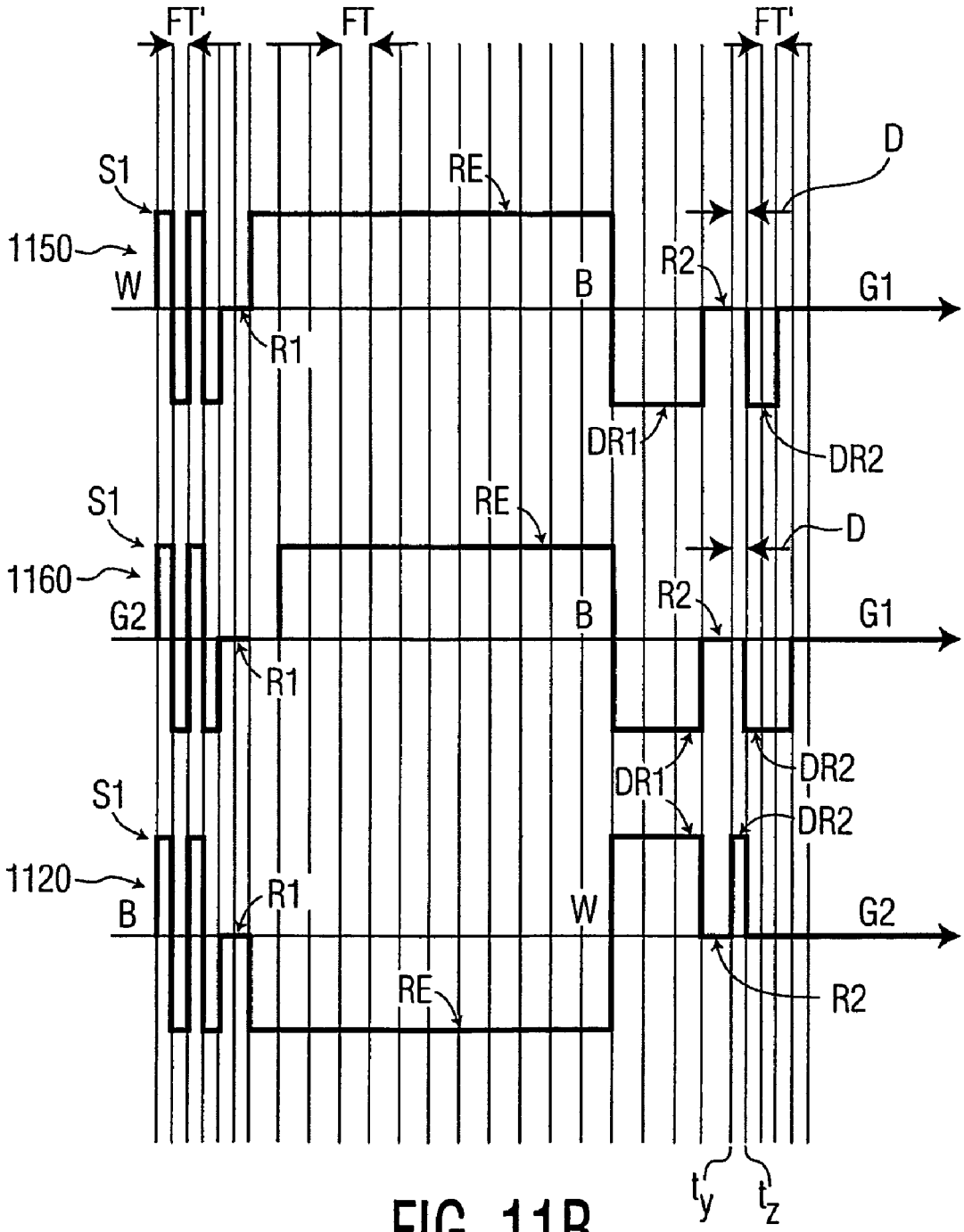
Figure 12:
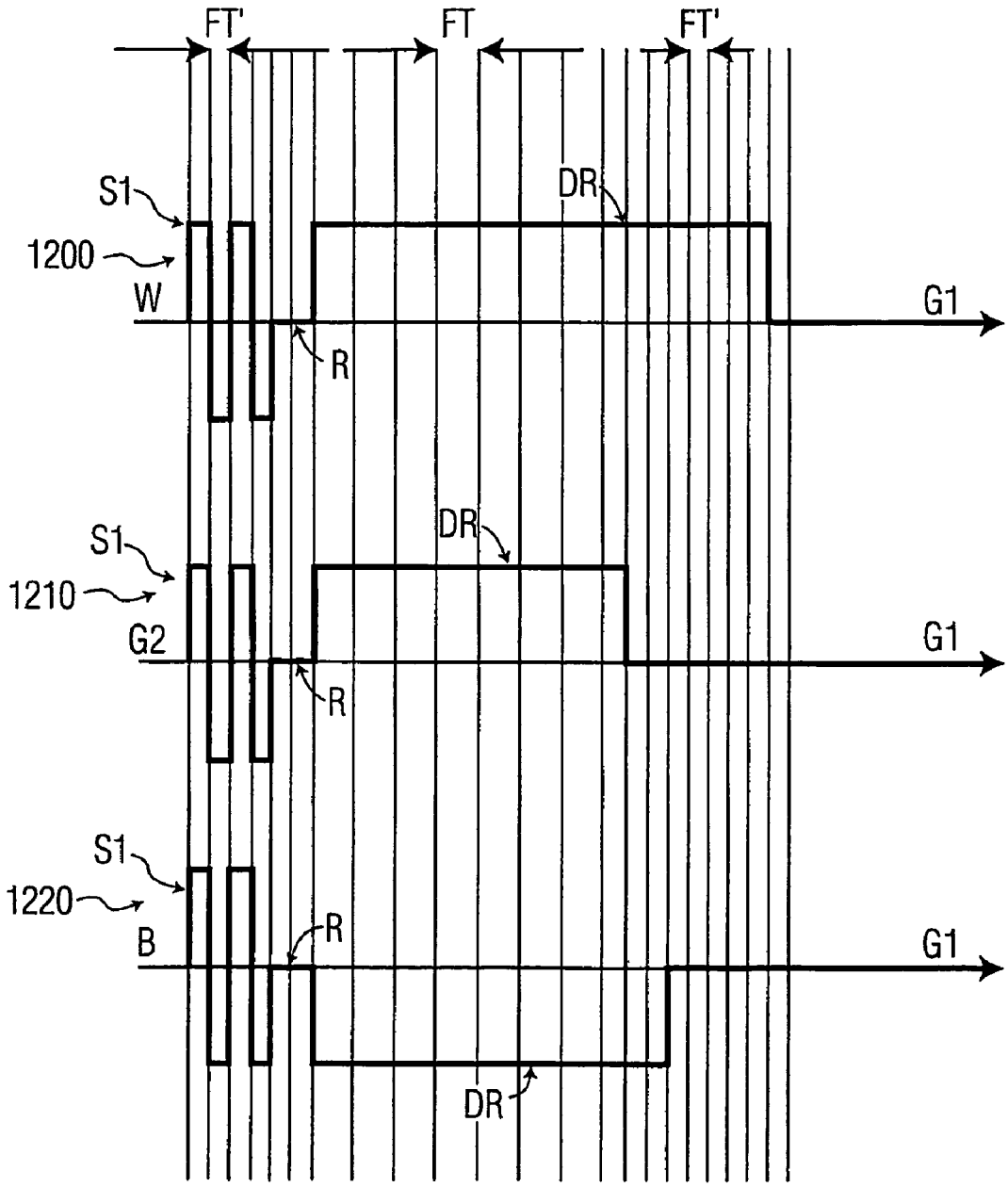
Figure 13:
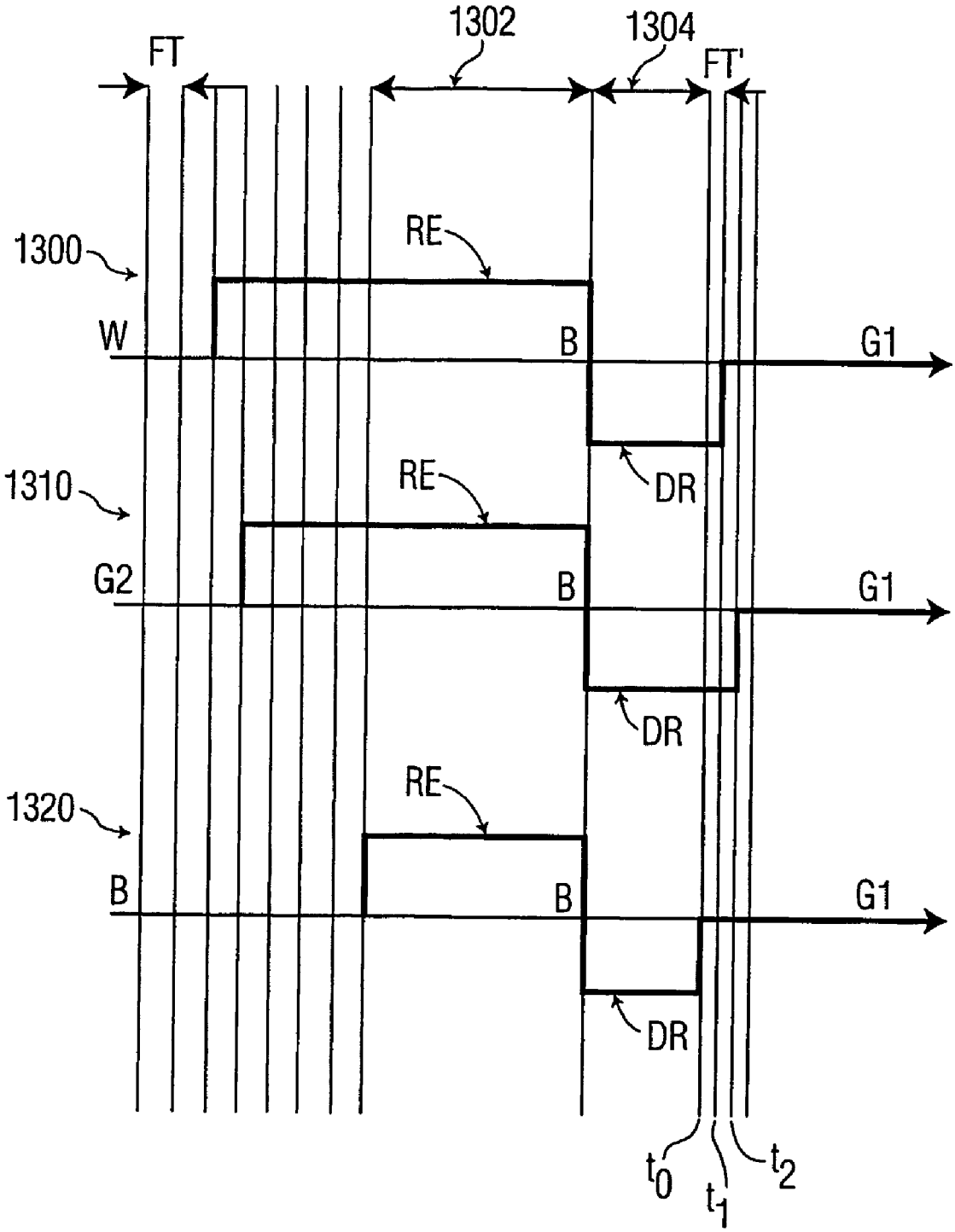
Figure 14:
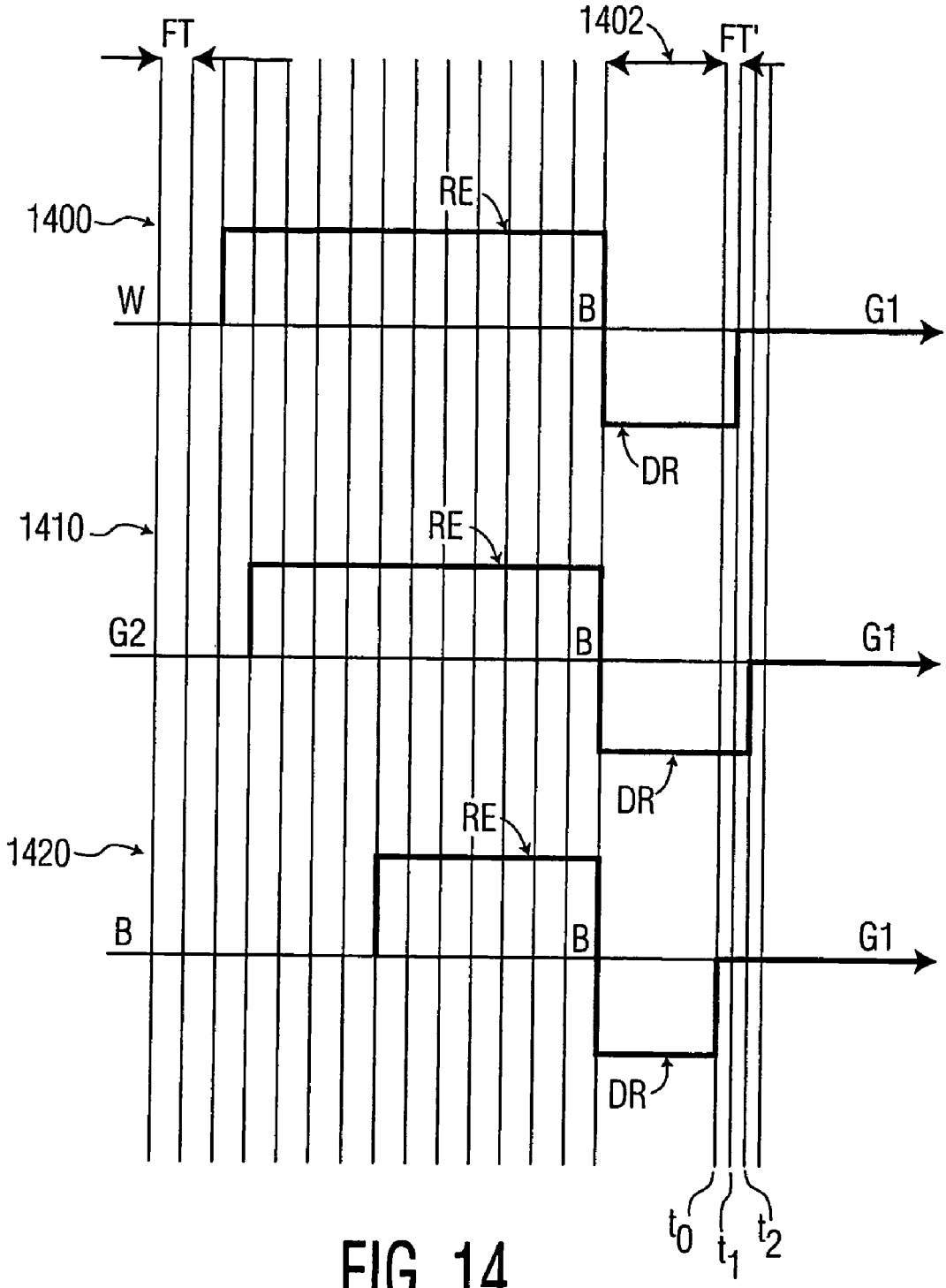
Figure 15:
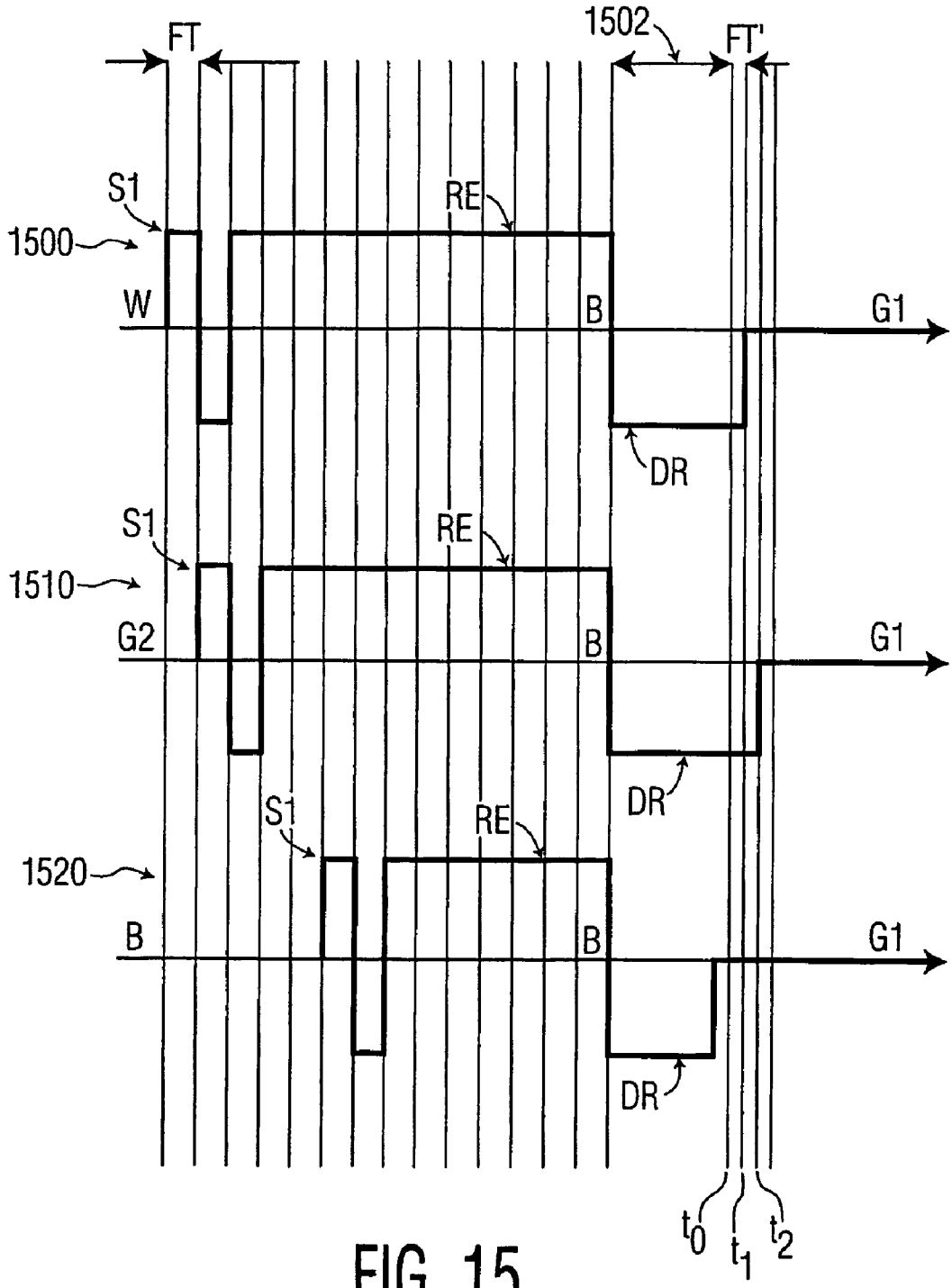
Figure 16:
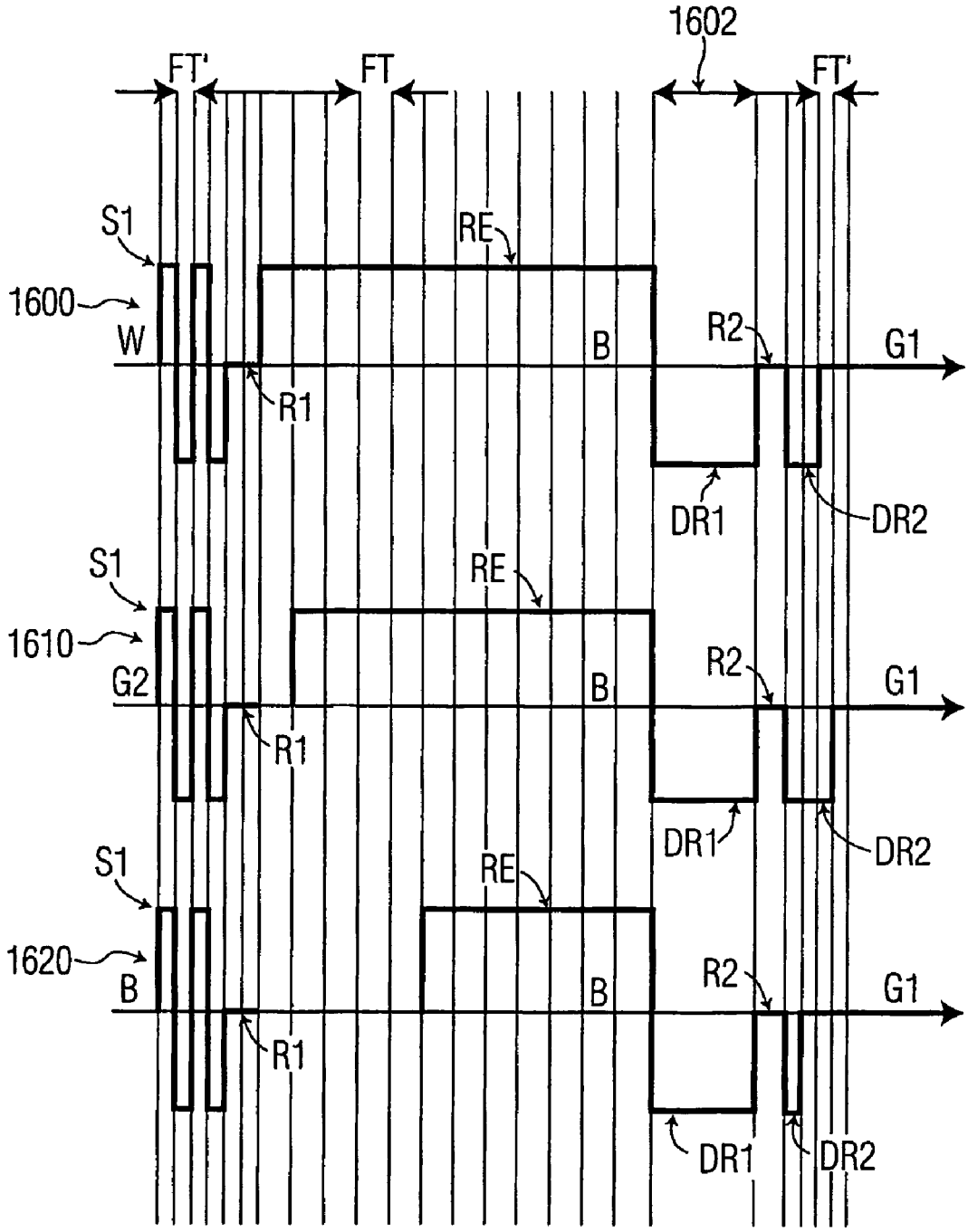
Figure 17A:
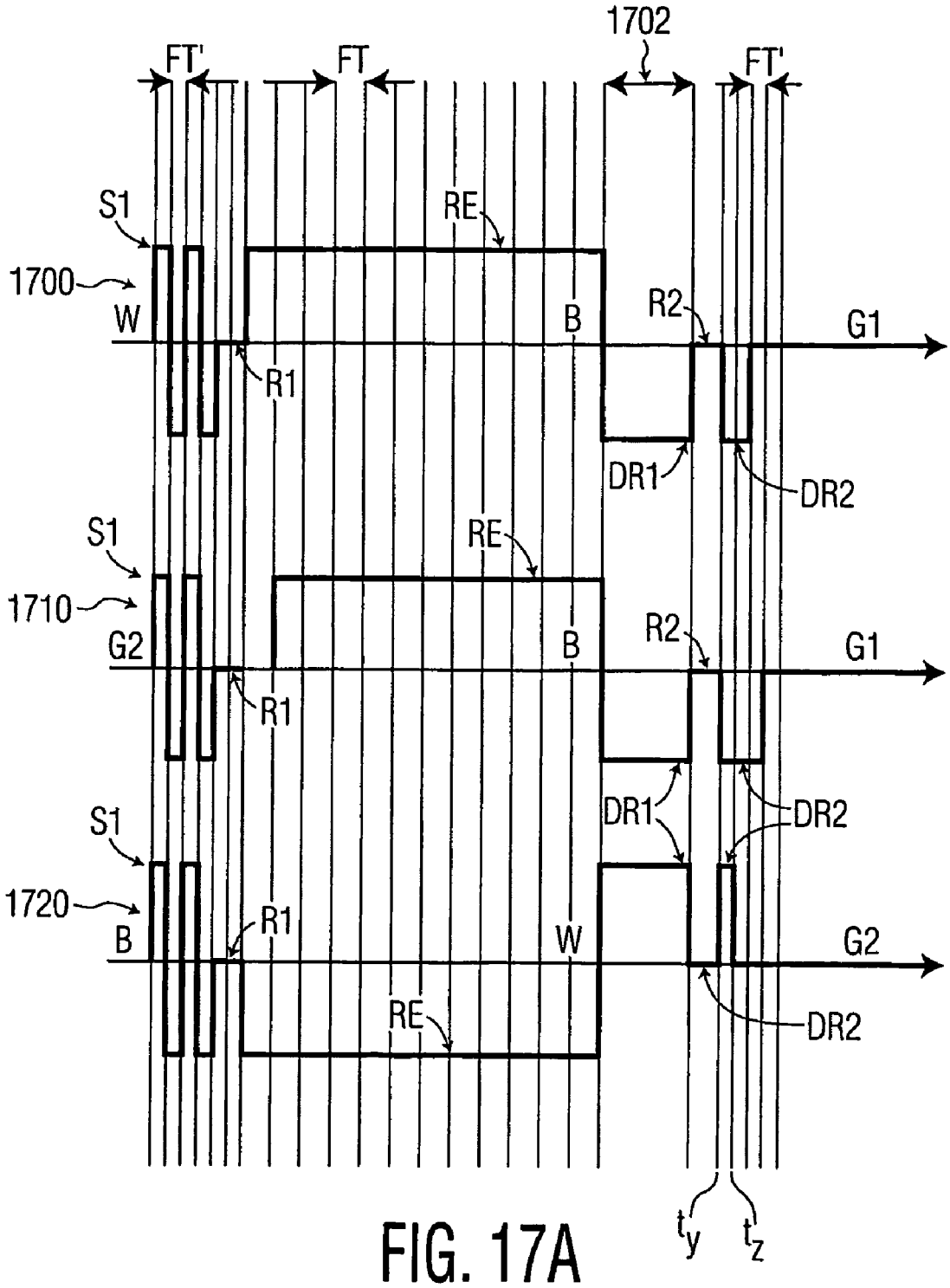
Figure 17B:
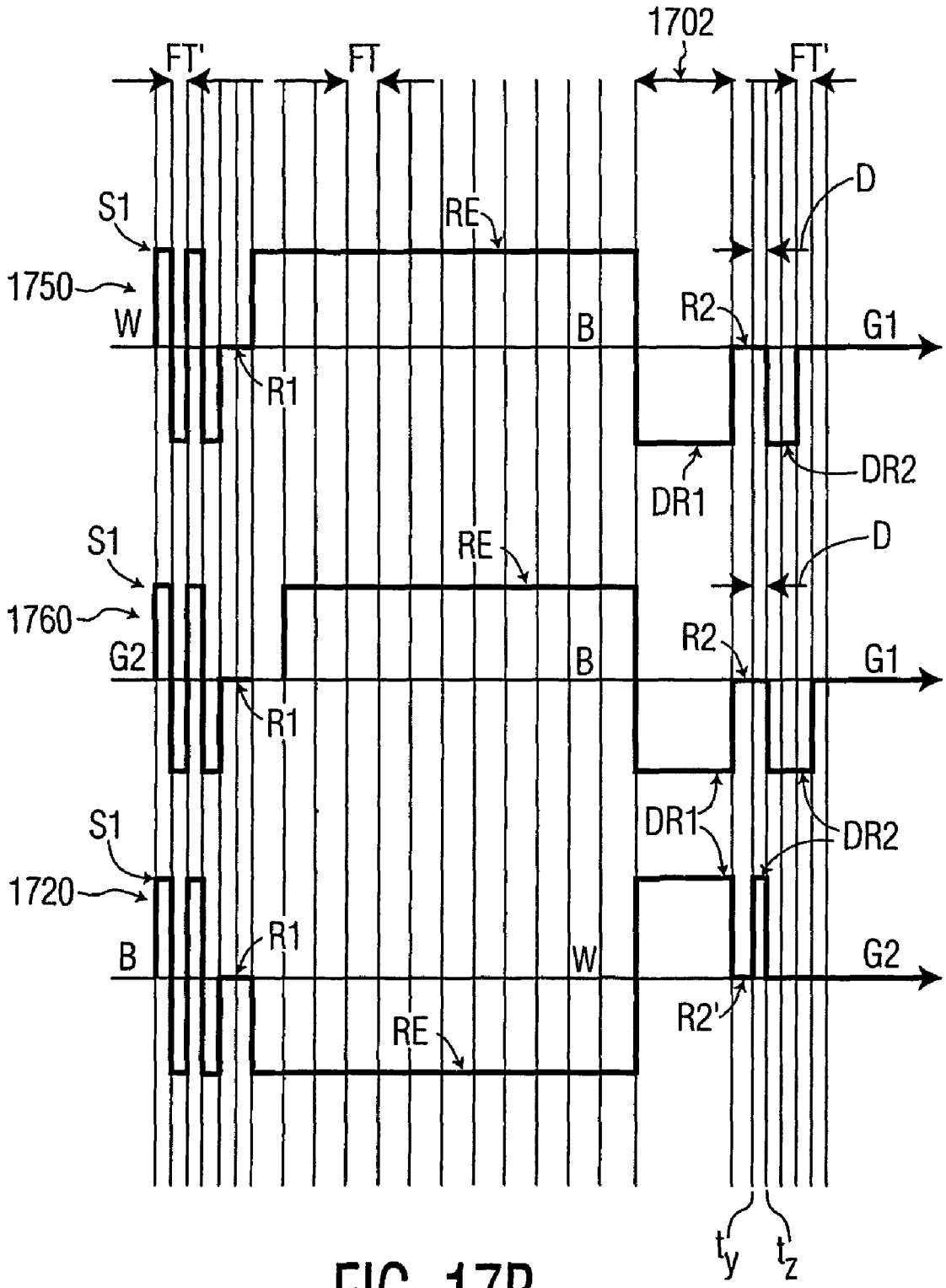
Figure 18:
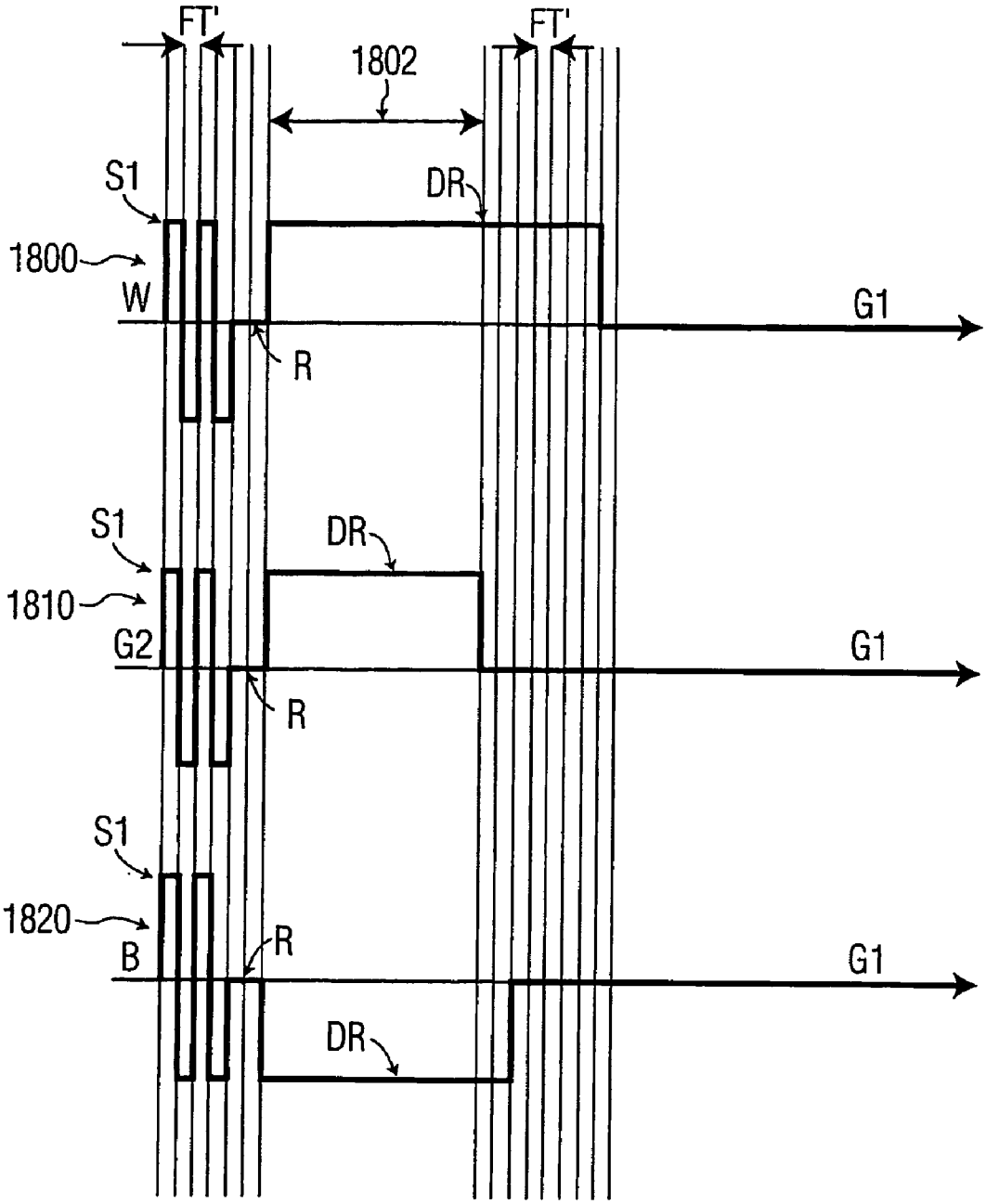

FIG. 5*a* illustrates waveforms for image transitions using a fixed, relatively long, frame time;

FIG. 5*b* illustrates waveforms for image transitions using a fixed, relatively short, frame time;

FIG. 6 illustrates waveforms for image transitions using a relatively short frame time for a drive portion, and a relatively long frame time for the remainder of the waveforms;

FIG. 7 illustrates waveforms for image transitions using a relatively short frame time for a terminal portion of a drive portion, and a relatively long frame time for the remainder of the waveforms;

FIG. 8 illustrates waveforms for image transitions using a relatively short frame time for a terminal portion of a drive portion, and a relatively long frame time for the remainder of the waveforms, including shaking pulses that are not time-aligned;

FIG. 9 illustrates waveforms for image transitions using a relatively short frame time for a terminal portion of a drive portion, and for shaking pulses that are time-aligned, and a relatively long frame time for the remainder of the waveforms;

FIG. 10 illustrates waveforms for image transitions using a relatively short frame time for shaking pulses and for a second portion of a drive portion, and a relatively long frame time for the remainder of the waveforms, where a rest portion is provided prior to a change in frame rate;

FIG. 11*a* illustrates waveforms for image transitions using different frame times, where starting points of second drive portions result in a full range voltage transition from a positive voltage to a negative voltage in a frame period;

FIG. 11*b* illustrates waveforms for image transitions using different frame times, where the starting point of a second drive portion is set to avoid a full range voltage transition from a positive voltage to a negative voltage in a frame period;

FIG. 12 illustrates waveforms for image transitions using different frame times, where the image transitions are realized directly without reset to a rail optical state;

FIG. 13 illustrates the waveforms of FIG. 6, where elongated frame times are provided in the reset and drive portions;

FIG. 14 illustrates the waveforms of FIG. 7, where an elongated frame time is provided in the drive portions;

FIG. 15 illustrates the waveforms of FIG. 8, where an elongated frame time is provided in the drive portions;

FIG. 16 illustrates the waveforms of FIG. 10, where an elongated frame time is provided in the first drive portions;

FIG. 17*a* illustrates the waveforms of FIG. 11*a*, where an elongated frame time is provided in the first drive portions;

FIG. 17*b* illustrates the waveforms of FIG. 11*b*, where an elongated frame time is provided in the first drive portions; and FIG. 18 illustrates the waveforms of FIG. 12, where an elongated frame time is provided in the drive portions.

In all the Figures, corresponding parts are referenced by the same reference numerals.

Each of the following is incorporated herein by reference:

European patent application EP 03100133.2, entitled "Electrophoretic display panel", filed Jan. 23, 2003;

European patent application EP 02077017.8, entitled "Display Device", filed May 24, 2002, or WO 03/079323, Electrophoretic Active Matrix Display Device", published Feb. 6, 2003; and European patent application EP 03101705.6, entitled "Electrophoretic Display Unit", filed Jun. 11, 2003.

Figure 1:
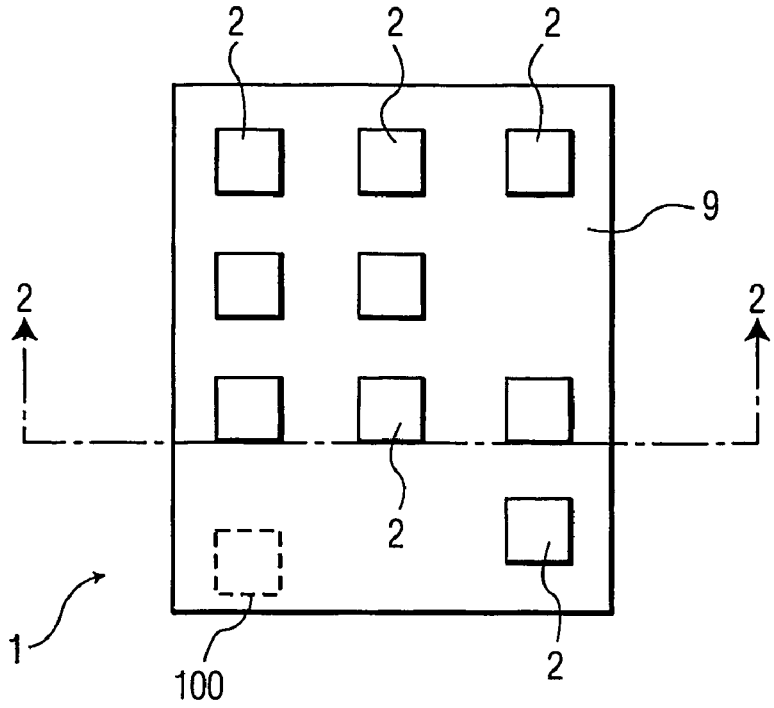
FIG. 1 shows diagramatically a front view of an embodiment of a portion of a display screen of an electronic reading device.
Figure 2:
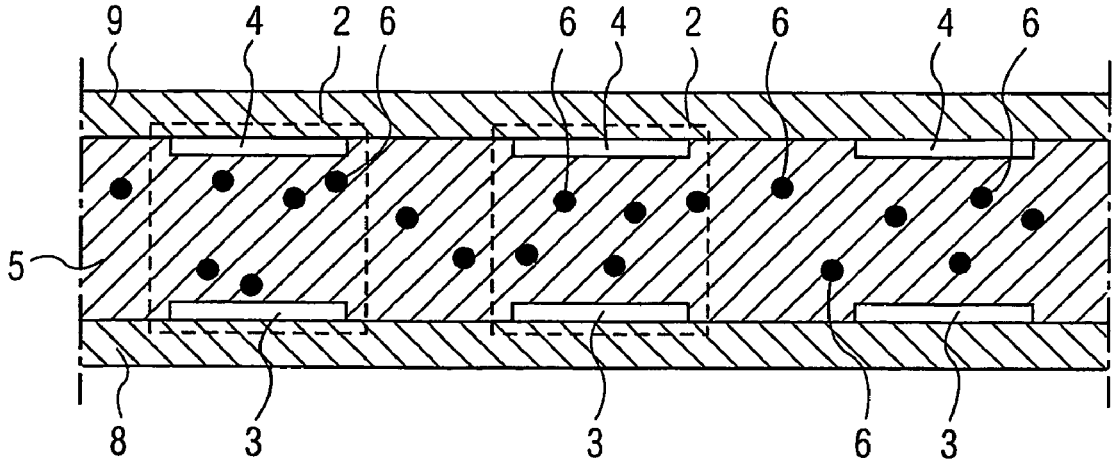
FIG. 2 shows diagramatically a cross-sectional view along 2-2 in FIG. 1.

FIGS. 1 and 2 show the embodiment of a portion of a display panel 1 of an electronic reading device having a first substrate 8, a second opposed substrate 9 and a plurality of picture elements 2. The picture elements 2 may be arranged along substantially straight lines in a two-dimensional structure. The picture elements 2 are shown spaced apart from one another for clarity, but in practice, the picture elements 2 are very close to one another so as to form a continuous image. Moreover, only a portion of a full display screen is shown. Other arrangements of the picture elements are possible, such as a honeycomb arrangement. An electrophoretic medium 5 having charged particles 6 is present between the substrates 8 and 9. A first electrode 3 and second electrode 4 are associated with each picture element 2. The electrodes 3 and 4 are able to receive a potential difference. In FIG. 2, for each picture element 2, the first substrate has a first electrode 3 and the second substrate 9 has a second electrode 4. The charged particles 6 are able to occupy positions near either of the electrodes 3 and 4 or intermediate to them. Each picture element 2 has an appearance determined by the position of the charged particles 6 between the electrodes 3 and 4. Electrophoretic media 5 are known per se, e.g., from U.S. Pat. Nos. 5,961,804, 6,120,839, and 6,130,774 and can be obtained, for instance, from E Ink Corporation.

As an example, the electrophoretic medium 5 may contain negatively charged black particles 6 in a white fluid. When the charged particles 6 are near the first electrode 3 due to a potential difference of, e.g., +15 Volts, the appearance of the picture elements 2 is white. When the charged particles 6 are near the second electrode 4 due to a potential difference of opposite polarity, e.g., −15 Volts, the appearance of the picture elements 2 is black. When the charged particles 6 are between the electrodes 3 and 4, the picture element has an intermediate appearance such as a grey level between black and white. An application-specific integrated circuit (ASIC) 100 controls the potential difference of each picture element 2 to create a desired picture, e.g. images and/or text, in a full display screen. The full display screen is made up of numerous picture elements that correspond to pixels in a display.

Figure 3:
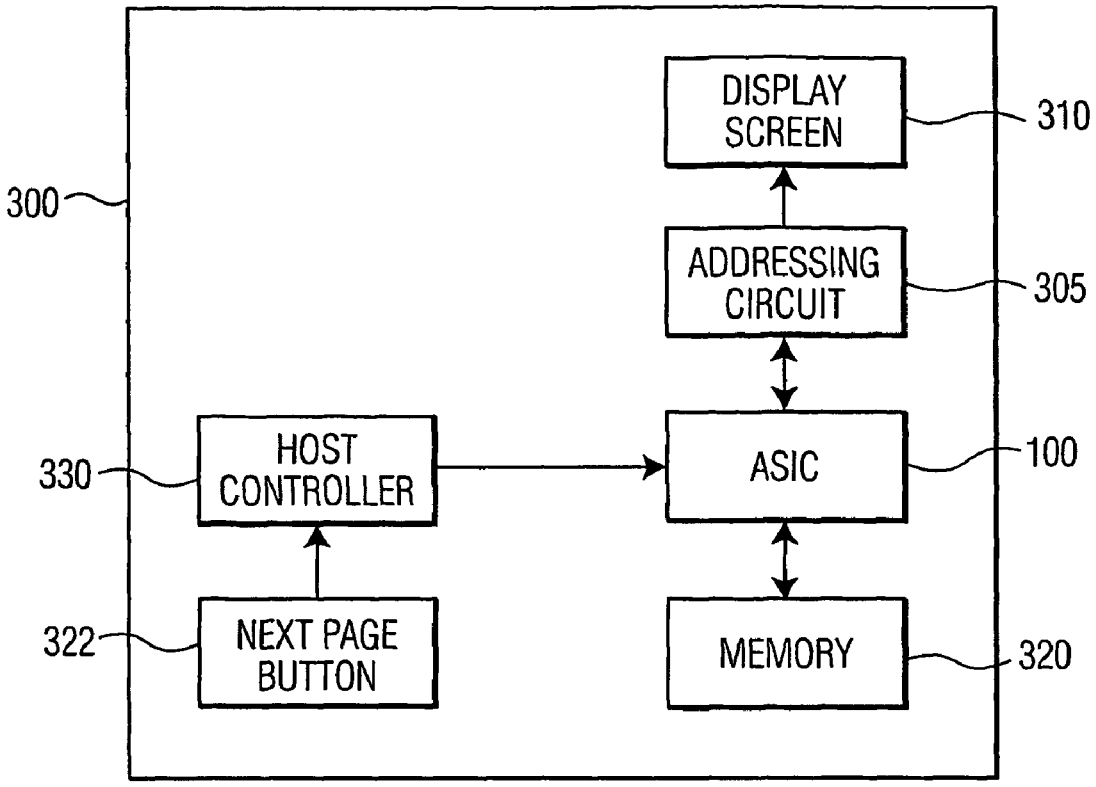
FIG. 3 shows diagramatically an overview of an electronic reading device.

FIG. 3 shows diagramatically an overview of an electronic reading device. The electronic reading device 300 includes the display ASIC 100. For example, the ASIC 100 may be the Philips Corp. "Apollo" ASIC E-ink display controller. The display ASIC 100 controls the one or more display screens 310, such as electrophoretic screens, via an addressing circuit 305, to cause desired text or images to be displayed. The addressing circuit 305 includes driving integrated circuits (ICs). For example, the display ASIC 100 may provide voltage waveforms, via an addressing circuit 305, to the different pixels in the display screen 310. The addressing circuit 305 provides information for addressing specific pixels, such as row and column, to cause the desired image or text to be displayed. The display ASIC 100 causes successive pages to be displayed starting on different rows and/or columns. The image or text data may be stored in a memory 320, which represents one or more storage devices. One example is the Philips Electronics small form factor optical (SFFO) disk system, in other systems a non-volatile flash memory could be utilized. The electronic reading device 300 further includes a reading device controller 330 or host controller, which may be responsive to a user-activated software or hardware button 322 that initiates a user command such as a next page command or previous page command.

The reading device controller 330 may be part of a computer that executes any type of computer code devices, such as software, firmware, micro code or the like, to achieve the functionality described herein. Accordingly, a computer program product comprising such computer code devices may be provided in a manner apparent to those skilled in the art. The reading device controller 330 may further comprise a memory (not shown) that is a program storage device that tangibly embodies a program of instructions executable by a machine such as the reading device controller 330 or a computer to perform a method that achieves the functionality described herein. Such a program storage device may be provided in a manner apparent to those skilled in the art.

The display ASIC 100 may have logic for periodically providing a forced reset of a display region of an electronic book, e.g., after every x pages are displayed, after every y minutes, e.g., ten minutes, when the electronic reading device 300 is first turned on, and/or when the brightness deviation is larger than a value such as 3% reflection. For automatic resets, an acceptable frequency can be determined empirically based on the lowest frequency that results in acceptable image quality. Also, the reset can be initiated manually by the user via a function button or other interface device, e.g., when the user starts to read the electronic reading device, or when the image quality drops to an unacceptable level.

Figure 4:
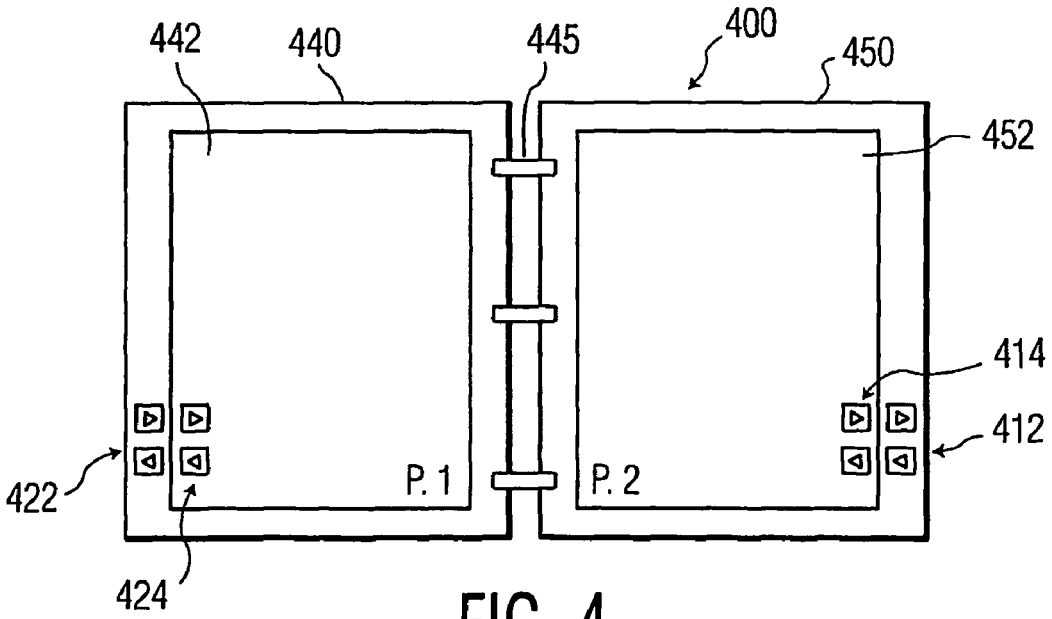
FIG. 4 shows diagramatically two display screens with respective display regions.

The ASIC 100 provides instructions to the display addressing circuit 305 for driving the display 310 based on information stored in the memory 320. The invention may be used with any type of electronic reading device. FIG. 4 illustrates one possible example of an electronic reading device 400 having two separate display screens. Specifically, a first display region 442 is provided on a first screen 440, and a second display region 452 is provided on a second screen 450. The screens 440 and 450 may be connected by a binding 445 that allows the screens to be folded flat against each other, or opened up and laid flat on a surface. This arrangement is desirable since it closely replicates the experience of reading a conventional book.

Various user interface devices may be provided to allow the user to initiate page forward, page backward commands and the like. For example, the first region 442 may include onscreen buttons 424 that can be activated using a mouse or other pointing device, a touch activation, PDA pen, or other known technique, to navigate among the pages of the electronic reading device. In addition to page forward and page backward commands, a capability may be provided to scroll up or down in the same page. Hardware buttons 422 may be provided alternatively, or additionally, to allow the user to provide page forward and page backward commands. The second region 452 may also include on-screen buttons 414 and/or hardware buttons 412. Note that the frame around the first and second display regions 442, 452 is not required as the display regions may be frameless. Other interfaces, such as a voice command interface, may be used as well. Note that the buttons 412, 414; 422, 424 are not required for both display regions. That is, a single set of page forward and page backward buttons may be provided. Or, a single button or other device, such as a rocker switch, may be actuated to provide both page forward and page backward commands. A function button or other interface device can also be provided to allow the user to manually initiate a reset.

In other possible designs, an electronic book has a single display screen with a single display region that displays one page at a time. Or, a single display screen may be partitioned into or two or more display regions arranged, e.g., horizontally or vertically. Furthermore, when multiple display regions are used, successive pages can be displayed in any desired order. For example, in FIG. 4, a first page can be displayed on the display region 442, while a second page is displayed on the display region 452. When the user requests to view the next page, a third page may be displayed in the first display region 442 in place of the first page while the second page remains displayed in the second display region 452. Similarly, a fourth page may be displayed in the second display region 452, and so forth. In another approach, when the user requests to view the next page, both display regions are updated so that the third page is displayed in the first display region 442 in place of the first page, and the fourth page is displayed in the second display region 452 in place of the second page. When a single display region is used, a first page may be displayed, then a second page overwrites the first page, and so forth, when the user enters a next page command. The process can work in reverse for page back commands. Moreover, the process is equally applicable to languages in which text is read from right to left, such as Hebrew, as well as to languages such as Chinese in which text is read column-wise rather than row-wise.

Additionally, note that the entire page need not be displayed on the display region. A portion of the page may be displayed and a scrolling capability provided to allow the user to scroll up, down, left or right to read other portions of the page. A magnification and reduction capability may be provided to allow the user to change the size of the text or images. This may be desirable for users with reduced vision, for example.

Problem Addressed

Pulse width-modulation (PWM) may be used for driving a bi-stable display such as an electrophoretic display, because of the relatively low price of the drivers and the higher image update speed obtained by using the highest voltage level. Using a drive waveform, the greyscale accuracy is limited by the time resolution, e.g., the minimum available frame time or unit time, which is usually a standard of 20 ms for a display with 600 lines at a frequency of 50 Hz, for instance. A shorter frame time has recently been achieved, which is 7.73 ms at a frequency of 150 Hz. The greyscale accuracy is significantly improved when a relatively short frame time is used because, during an image update in an active matrix display, the voltage pulse is supplied from the data driver on a frame-by-frame basis. A short frame time ensures that the pixel receives the correct amount of impulse as nominally desired.

This is illustrated in FIGS. 5*a* and 5*b* for some example image transitions using rail-stabilized driving, as discussed in the above-referenced European patent application EP 03100133.2. FIG. 5*a* illustrates waveforms for image transitions using a fixed, relatively long, frame time. The image transitions include White (W) to Dark grey (G1) (waveform 500), Light grey (G2) to Dark grey (G1) (waveform 510), and Black (B) to Dark grey (G1) (waveform 520). The notation "B" indicates that the display has been drive to the black state. A relatively long frame time (FT) of, e.g., 20 ms is used. Note that addressing of the pixels can terminate when no further non-zero voltages are applied. Also, note that the waveforms shown are only a subset of all possible waveforms. For example, sixteen waveforms may be used with a two-bit greyscale.

FIG. 5*b* illustrates waveforms for image transitions using a fixed, relatively short, frame time. The image transitions include White (W) to Dark grey (G1) (waveform 550), Light grey (G2) to Dark grey (G1) (waveform 560), and Black (B) to Dark grey (G1) (waveform 570). Here, a relatively short frame time (FT') of, e.g., 10 ms is used. Moreover, the drive waveform includes a reset portion or pulse (RE) and a drive portion or pulse (DR).

In FIG. 5*a*, in the transition from W to G1, in waveform 500, the time resolution of 20 ms is sufficiently high to obtain the exactly desired impulse. This is seen by the fact that the drive portion (DR) of the waveform has a duration of exactly four frame periods or frame times, and terminates exactly at time t1. However, in the transition from G2 to G1, in waveform 510, the time resolution of 20 ms is insufficient to obtain the exact desired greyscale drive impulse. The waveform 510 is shown having a desired duration of four and one-half frame times, and terminating at a time between frames at times t1 and t2. In practice, a half frame time cannot be used. Instead, an under drive occurs when four frames of 20 ms are used, or an over drive occurs when five frames of 20 ms are used. A similar problem appears in the transition from B to G1, in waveform 520. The waveform 520 is shown having a desired duration of three and one-half frame times, and terminating at a time between frames at times t0 and t1. An under drive occurs when three frames of 20 ms are used, or an overdrive occurs when four frames of 20 ms are used. In either case, both the reset and greyscale drive portions will experience an under drive or overdrive.

Generally, note that the reset portion (RE) may have an over-reset duration that is longer than the minimum time required to drive the particles from their current optical state to the rail state. Over-reset pulses are discussed in the above-referenced co-pending European patent application 03100133.2.

In FIG. 5*b*, the frequency is doubled for the duration of the waveforms, with a frame time (FT') of 10 ms. While this approach avoids an under drive or overdrive in all transitions, the power consumption becomes unacceptably high when a constantly high frequency is used due to switching of the column drivers.

In our experiments, we noted that the relatively long pulses such as the reset portion (RE) are not critical to the time resolution. It is therefore proposed to use mixed frequencies or frame times for generating the impulses to achieve accurate greyscale with minimized power consumption. In particular, a high frequency is used only for the relatively short pulses, e.g. the greyscale driving pulse or the last or terminal part of the greyscale driving pulse, and a low frequency is used for generating the reset pulse.

Proposed Solution

A driving method of achieving accurate greyscale and increasing the number of grey levels is proposed for a bi-stable display such as an active matrix electrophoretic display using mixed frequency during an image update period. Drive waveforms for various greyscale image transitions are intentionally split in more than one block, and different scanning rates may be used in each block of the waveform for generating the impulse. This makes it possible to use a high frequency or shorter frame time, when necessary, for the waveform portions requiring high time-resolution. An example of this is the terminal portion of the greyscale driving pulse. Moreover, a lower frequency or longer frame time can be used for waveform portions where the time-resolution is not critical. An example of this is the reset portion of the waveform. In this way, accurate greyscale is achieved with minimized average power consumption.

This invention is applicable to any driving scheme, including direct grey-to-grey driving schemes and rail-stabilized driving schemes in which the driving pulses include reset pulses and greyscale driving pulses. The reset pulse is the voltage pulse that moves particles to one of the two extreme optical states. The greyscale driving pulse is the voltage pulse that sends the display/pixel to the desired final optical state. In the following embodiments, rail-stabilized driving as discussed in the above-referenced European patent application EP 03100133.2 is mainly used for explaining the invention. However, other driving schemes may be used. Also, examples are given for directly driving from one optical state to another in FIG. 12, without resetting to a rail state.

EMBODIMENT 1

FIG. 6 illustrates waveforms for image transitions using a relatively short frame time for a drive portion, and a relatively long frame time for the remainder of the waveforms. Waveforms 600, 610 and 620, corresponding to the waveforms 500, 510 and 520, respectively of FIG. 5*a*, are shown for image transitions from White (W) to Dark grey (G1), Light grey (G2) to Dark grey (G1) and Black (B) to Dark grey (G1), respectively, using rail-stabilized driving. A relatively long frame time (FT) of, e.g., 20 ms is used for the reset portion (RE), and a relatively short frame time (FT') of, e.g., 10 ms is used for the greyscale driving portion (DR). The use of the relatively low frequency in the reset portion (RE) results in a very low power consumption, including both the average and peak power. Since the reset pulse (RE) is usually long and is less sensitive to the exact frame time, it is possible to chose the frequency to be as low as possible, e.g. 20 Hz (FT=50 ms) or lower. Equivalently, the frame time is chosen to be as long as possible.

Furthermore, note that an under drive or overdrive in the reset portion may be caused by the long frame time, e.g., if the desired reset pulse terminates between frame boundaries. However, this can be corrected/compensated for by adjusting the subsequent greyscale driving pulse. For example, if the reset pulse is under driven, e.g., shorter than desired, the driving pulse can be made shorter for compensating the under drive reset pulse. Similarly, if the reset pulse is overdriven, e.g., longer than desired, the driving pulse can be made longer.

The introduction of high frequency in the driving portion (DR) of the waveforms ensures the accuracy of the greyscale. This can be seen in that, in contrast to the waveforms 510 and 520 of FIG. 5*a*, the drive portions (DR) of the waveforms 610 and 620 terminate on a frame boundary, at times t0 and t2, respectively. The drive portion (DR) of the waveform 600 terminates on the frame boundary at time t1, as with the waveform 500 of FIG. 5*a*. The increased average power consumption in the greyscale driving portion (DR) is compensated by the significantly decreased power consumption during the reset portion (RE), resulting in overall low power consumption.

EMBODIMENT 2

FIG. 7 illustrates waveforms for image transitions using a relatively short frame time for a terminal portion of a drive portion, and a relatively long frame time for the remainder of the waveforms. Waveforms 700, 710 and 720, corresponding to the waveforms 500, 510 and 520, respectively of FIG. 5*a*, are shown for image transitions from White (W) to Dark grey (G1), Light grey (G2) to Dark grey (G1) and Black (B) to Dark grey (G1), respectively, using rail-stabilized driving. A relatively long frame time (FT) is used for both the reset portion (RE) and an initial part of the greyscale driving pulse (DR), while a relatively short frame time (FT') is used for the terminal part of the greyscale driving portion (DR), through the end of the waveform. For waveform 700, for instance, the first three frame times of the driving portion (DR) have the longer frame time (FT), while the last two frame times have the shorter frame time (FT'). [RFH1]Compared to the first embodiment, the present approach results in a still lower overall average power consumption without reducing the greyscale accuracy.

Note also, generally, that it is possible to have a shorter frame time around the start and/or end of a reset portion of a waveform.

EMBODIMENT 3

FIG. 8 illustrates waveforms for image transitions using a relatively short frame time for a terminal portion of a drive portion, and a relatively long frame time for the remainder of the waveforms, including shaking pulses that are not time-aligned. Waveforms 800, 810 and 820 are shown for image transitions from White (W) to Dark grey (G1), Light grey (G2) to Dark grey (G1) and Black (B) to Dark grey (G1), respectively, using rail-stabilized driving. The waveforms 800, 810 and 820, respectively, correspond to the waveforms 500, 510 and 520, but shaking pulses (S1) are added. Here, a long frame time (FT) is used for both the reset portion (RE) and a large part of the greyscale driving pulse (DR), and a short frame time (FT') is used for the last, small part of the greyscale driving portion (DR). Moreover, two shaking pulses (S1) are added prior to the reset pulse (RE) in all transitions. The shaking pulses (S1) have a time period equal to the frame time of the reset portion (RE). Shaking pulses are extremely useful in removing the pixel history, thus reducing image retention as discussed in more detail in the above-referenced European patent application EP 02077017.8. Optical flicker induced by using a relatively long frame time may be reduced by column inversion or column shift In this example, the shaking pulses (S1) are timed directly prior to the reset pulse (RE) in each waveform. However, the shaking pulses occur at different times for the different waveforms 800, 810 and 820. It is also possible for the shaking pulses to be time-aligned in the different waveforms so that during a common shaking period, shaking pulses in all waveforms occur during the same frames. This may further reduce power consumption and increase efficiency. Furthermore, it is sometimes desirable to have a second set of shaking pulses prior to the driving pulse as discussed in the above-referenced European patent application EP 03100133.2, for further reducing image retention.

EMBODIMENT 4

FIG. 9 illustrates waveforms for image transitions using a relatively short frame time for a terminal portion of a drive portion, and for shaking pulses that are time-aligned, and a relatively long frame time for the remainder of the waveform. Waveforms 900, 910 and 920 are shown for image transitions from White (W) to Dark grey (G1), Light grey (G2) to Dark grey (G1) and Black (B) to Dark grey (G1), respectively, using rail-stabilized driving. The waveforms 900, 910 and 920, respectively, correspond to the waveforms 500, 510 and 520, but shaking pulses (S1) are added. The shaking pulses (S1) are aligned in time in all waveforms, and each shaking pulse has a pulse length, e.g., frame time (FT'), equal to the frame time of the driving pulse (DR). The optical flicker induced by the shaking pulses is much lower than in embodiment 3 without using column inversion. The aligned shaking pulses (S1) also make it possible to simultaneously address a group of lines in parallel so that still shorter frame time is possible only for the shaking pulses, forming data-independent "hardware shaking". In the case of waveform (data) dependent shaking, a shaking pulse time may also be different from any of the frame times used in other portions of the waveforms. Similar variations may apply to the second set of shaking pulse, which are sometimes desired and used, e.g., prior to the greyscale driving pulse (DR).

EMBODIMENT 5

FIG. 10 illustrates waveforms for image transitions using a relatively short frame time for shaking pulses and for a second portion of a drive portion, and a relatively long frame time for the remainder of the waveforms, where a rest portion is provided prior to a change in frame rate. Waveforms 1000, 1010 and 1020 are shown for image transitions from White (W) to Dark grey (G1), Light grey (G2) to Dark grey (G1) and Black (B) to Dark grey (G1), respectively, using rail-stabilized driving. The waveforms 1000, 1010 and 1020, respectively, correspond to the waveforms 500, 510 and 520, but shaking pulses (S1) are added, and the drive portion includes first and second drive portions, DR1 and DR2, respectively.

The shaking pulses (S1) are aligned in time in all waveforms and each shaking pulse has a pulse length or frame time (FT') that is shorter than the frame time (FT) of the reset portion (RE). Moreover, a rest pulse (R1, R2), which is a voltage pulse with a voltage level of substantially zero or below a threshold voltage that would cause the particles to move, is generally supplied prior to the switch from one frequency to the other. In this example, a first rest pulse (R1) is supplied between the shaking pulses (S1) and the reset pulse (RE) with a time period at least as long as the present frame time (FT'). For example, in the waveforms 1000, 1010 and 1020, the first rest pulse (R1) has a duration of two short frame times (FT'). In a further approach, the first rest pulse (R1) could have a duration of a single frame time (FT') Also, a second rest pulse (R2) is supplied after the completion of the third frame (FT) of the first drive pulse portion (DR1), e.g., at the end of the first drive pulse portion (DR1), and prior to the switch to high frequency (FT'). The second rest pulse (R2) has a time period at least as long as the present frame time (FT). In other words, the second rest pulse (R2) is supplied after the first drive pulse portion (DR1) and prior to the second drive pulse portion (DR2). With this approach, vertical cross talk induced by the frequency change is avoided.

EMBODIMENT 6

FIG. 11*a* illustrates waveforms for image transitions using different frame times, where starting points of second drive portions result in a full range voltage transition from a positive voltage to a negative voltage in a frame period. Waveforms 1000 and 1010 from FIG. 10 are repeated as the first two waveforms. The third waveform, waveform 1120, differs in that it shows a transition from Black (B) to Light grey (G2). W denotes the white state. Again, rail-stabilized driving is used. A relatively long frame time (FT) is used for the reset portion (RE) and the first drive portion (DR1), and a short frame time (FT') is used for the second drive portion (DR2).

Since the image transition B to G2 in waveform 1120 is realized via an opposite rail (W) than the rail use by the waveforms 1000 and 1010, the second drive portion (DR2) requests a positive voltage such as +15 V between frame boundaries ty and tz. During this time, the waveforms 1000 and 1010 request a negative voltage such as −15 V. As a result, the voltage source driver output transitions directly from −15V to +15V or 15V to −15V in a single frame as the image on the display device is being updated. This is undesirable since the requested power is high. Generally, when a low frequency is used, the peak power consumption can still be low, but when a high frequency is used it may become unacceptably high.

By reducing the voltage swing or span within one or more frames, power consumption is significantly reduced. In particular, the peak power consumed by a bi-stable device is proportional to the square voltage-change, i.e., $P \propto C \times (\Delta V)2$, where C denotes capacitance. More specifically, the peak power consumed is the product of the capacitance×frequency×voltage swing×supply voltage. The supply voltage for the IC or chip that supplies voltage to pixels in the bi-stable device, such as in the addressing circuit 305, must be at least equal to the voltage swing and may be 30 V, for example. The voltage swing or span is the range of possible voltages used, e.g., 30 V (+15 V−(−15V)). Thus, reducing the voltage swing by half, to 15V, reduces power consumption by half during specific frames. However, the supply voltage can be reduced according to the reduced voltage swing, to e.g., 15 V. This reduces power consumption to one-fourth its original amount. As a result of the reduced supply voltage and voltage swing, a frame time of as short as one-fourth of the standard frame time may be used while maintaining the same low power consumption.

To overcome this problem, part of the waveform should be aligned in time such that a direct transition from −15V to 15V or 15V to −15V in a single frame is avoided, as illustrated in FIG. 11*b*. FIG. 11*b* illustrates waveforms for image transitions using different frame times, where the starting point of a second drive portion is set to avoid a full range voltage transition from a positive voltage to a negative voltage in a frame period. In this approach, driving waveforms for various greyscale image transitions are intentionally aligned in time such that voltage changes are constrained to a subset range of possible voltage values during one or more frames. In other words, full range voltage swings between maximum and minimum values are avoided. For example, when the range of possible voltages is between −15 V and +15 V in the waveforms, variations from −15 V to +15 V, or from +15 V to −15 V, are avoided for specific portions of the waveforms. Instead, variations between −15 V and 0 V, or between 0 V and +15 V, are allowed for the specific portions of the voltage waveforms. These waveform portions may include data-dependent portions of the waveform in which a relatively shorter frame period is used.

In FIG. 11*b*, the first waveform 1150 is the same as the waveform 1000 except a delay (D) is provided following the second rest pulse (R2) and before the second drive portion (DR2). The delay (D) occurs during the time between ty and tz. The second drive portion (DR2) is accordingly shifted one frame time (FT') to the right. The second waveform 1160 is the same as the waveform 1010 except a delay (D) is also provided following the second rest pulse (R2) and before the second drive portion (DR2), during the time between ty and tz. The second drive portion (DR2) is accordingly shifted one frame time (FT') to the right. Thus, each of the voltage waveforms includes first drive portions (DR1), and time-aligned second drive portions (DR2) with a reduced range of voltage values.

In the frame between ty and tz, the waveforms 1150 and 1160 request 0 V, while the waveform 1120 requests +15 V. Accordingly, the variation in voltage levels is only 15 V in this frame, which is a subset of the full range of 30 V. Similarly, in the frame starting at tz, the waveforms 1150 and 1160 request −15 V, while the waveform 1120 requests 0 V. Again, the variation in voltage levels is only 15 V in the frame. The delay (D) is used to align the second drive portions (DR2) to allow the use of high frequency while maintaining a relatively low peak power consumption. A disadvantage is that the total image update time is somewhat increased. Other ways of aligning the pulses are also possible to achieve the goal of avoiding a full range voltage swing in a single short-frame time.

EMBODIMENT 7

FIG. 12 illustrates waveforms for image transitions using different frame times, where the image transitions are realized directly without reset to a rail optical state. Waveforms 1200, 1210 and 1220 are shown for image transitions from White (W) to Dark grey (G1), Light grey (G2) to Dark grey (G1) and Black (B) to Dark grey (G1), respectively, using direct grey-to-grey driving without reset to the rails. Each waveform includes shaking pulses (S1), a rest pulse (R), and a drive pulse (DR). A long frame time (FT) is used for the majority of the initial portion of the driving pulse (DR). A short frame time (FT') is used for the last or terminal portion of the driving pulse (DR), and for the shaking pulse (S1). In particular, the short frame time (FT') begins one frame prior to the end of the driving pulse (DR) in waveform 1210.

As discussed, the rest pulse (R) is used prior to a switch in frequency/frame rate. Moreover, the pulses should be aligned in time at the portion where a high frequency is used, and a −15V to +15V voltage swing is encountered in a single frame as discussed above (they are not shown in the figure). It is sometimes possible to remove the shaking pulses (S1), for example, when the ink is independent of or less dependent on the image history, or the previous image history is considered in determining the look-up-table.

Elongated Frame Times

As mentioned, power consumption in a bi-stable device can become unacceptably high when a constantly high frequency is used due to switching of the column drivers. In particular, while individual pixels may have the same voltage for multiple frames, there will be pixels on different rows that are running different waveforms (e.g., with positive, zero, or negative voltages). In this case, the column (data) drivers will have to keep switching between the different voltages, which consumes power. If this is only done once, instead of many times, the total energy dissipated will be lower. In one approach, a longer frame time can be implemented by scanning through the frame more slowly (e.g., with a longer line time), which reduces average power dissipation as the frequency goes down. Another approach is to scan through the frame at the normal speed and then simply delay writing the following frame for a given delay time. In this case, local power dissipation is the same, but total energy is lower, since no power is consumed during the delay time.

Accordingly, a further aspect of the invention is to create the longest possible and the longest practical frame periods for a single waveform. In this case, the frame period for at least a portion of a waveform is defined as the longest possible frame period between any changing of the pixel voltage. That is, the elongated frame period is a frame period, e.g., the longest possible frame period, during which the voltage waveform has a constant voltage value. This approach is limited, e.g., to the situation where the entire display is reset, in a single long voltage pulse, to white or black and those pixels that must be black or white, respectively, are driven with a single waveform.

In another approach, we create the longest possible and the longest practical mutual frame periods of a set of at least two waveforms. The frame period for at least a portion of the waveform is defined as the longest possible frame period between any changing of the pixel voltage in any of the driving waveforms, e.g., the longest mutual period where both or all waveforms have the same data voltage.

Note that we cannot reasonably use frame times above a time after which the pixel voltage drops too much due to leakage in the pixel. This varies with the device used. An example is 100 ms. The change in pixel voltage is defined as a x % reduction in pixel voltage compared to the addressed voltage. This accounts for leakage of charge from a pixel in the period between two successive addressing points in an active matrix drive—x could be about 5-10%. Thus, the elongated frame time need not be the longest possible frame time.

The use of an elongated frame time is illustrated in the following examples.

FIG. 13 illustrates the waveforms of FIG. 6, where elongated frame times are provided in the reset and drive portions. The waveforms 1300, 1310 and 1320 correspond to the waveforms 600, 610 and 620, respectively, but a long frame period is provided for the reset portions (RE) and the drive portions (DR). In particular, the frame period 1302 for the reset portions (RE) is the duration of the shortest reset portion among the waveforms, which is in waveform 1320. Similarly, the frame period 1304 for the drive portions (DR) is the duration of the shortest drive portion among the waveforms, which is also in waveform 1320.

Generally, the frame period duration is limited by the longest period that overlaps with all possible transition waveforms. Note that the waveforms shown are only a subset of all possible, e.g., sixteen, waveforms. In practice, all transition waveforms would be considered to determine the location and duration of the longest possible frame time. In other words, the elongated frame period can be defined for a reset portion, for instance, by asking: What is the longest common time period in which either a reset portion of either voltage polarity or a continuous 0V signal occurs in each voltage waveform? Moreover, to still further reduce the power dissipation, it is possible to assign an additional longer frame period between the start of the reset pulse of waveform 1310, and the start of the reset pulse of waveform 1320, as here the waveforms require either a continuous reset voltage, e.g., +15 V for waveforms 1300 and 1310, or a continuous zero voltage, in waveform 1320. Thus, a plurality of elongated frame periods can be used for a given set of waveforms.

FIG. 14 illustrates the waveforms of FIG. 7, where an elongated frame time is provided in the drive portions. The waveforms 1400, 1410 and 1420 correspond to the waveforms 700, 710 and 720, respectively, but a long frame period 1402 is provided for the drive portions (DR). The frame period for the drive portions (DR) is the duration of the shortest drive portion among the waveforms, which is in waveform 1420.

FIG. 15 illustrates the waveforms of FIG. 8, where an elongated frame time is provided in the drive portions. The waveforms 1500, 1510 and 1520 correspond to the waveforms 800, 810 and 820, respectively, but a long frame period 1502 is provided for part of the drive portions (DR). The frame period for the part of the drive portions (DR) is the duration of the shortest drive portion among the waveforms, which is in waveform 1520.

FIG. 16 illustrates the waveforms of FIG. 10, where an elongated frame time is provided in the first drive portions. The waveforms 1600, 1610 and 1620 correspond to the waveforms 1000, 1010 and 1020, respectively, but a long frame period 1602 is provided for the first drive portions (DR1). The frame period for the first drive portions (DR1) is the duration of the shortest first drive portion among the waveforms. In this case, all first drive portions have the same duration.

FIG. 17*a* illustrates the waveforms of FIG. 11*a*, where an elongated frame time is provided in the first drive portions. The waveforms 1700, 1710 and 1720 correspond to the waveforms 1000, 1010 and 1120, respectively, but a long frame period 1702 is provided for the first drive portions (DR1). The frame period for the first drive portions (DR1) is the duration of the shortest first drive portion among the waveforms. In this case, all first drive portions have the same duration.

FIG. 17*b* illustrates the waveforms of FIG. 11*b*, where an elongated frame time is provided in the first drive portions. The waveforms 1750, 1760 and 1720 correspond to the waveforms 1150, 1160 and 1120, respectively, but the long frame period 1702 is provided for the first drive portions (DR1). The frame period for the first drive portions (DR1) is the duration of the shortest first drive portion among the waveforms. In this case, all first drive portions have the same duration.

FIG. 18 illustrates the waveforms of FIG. 12, where an elongated frame time is provided in the drive portions. The waveforms 1800, 1810 and 1820 correspond to the waveforms 1200, 1210 and 1220, respectively, but a long frame period 1802 is provided for the drive portions (DR). The frame period for the drive portions (DR) is the duration of the shortest drive portion among the waveforms, which in this case is waveform 1810.

Remarks

In the above examples, different frequencies are used for reset and drive portions. More generally, this invention is applicable to multiple blocks of the waveform. It allows one to intentionally split the waveform in more than one block where each block pulse is generated using a different frequency.

Moreover, in the above examples, pulse-width modulated (PWM) driving is used for illustrating the invention, where the pulse time is varied in each waveform while the voltage amplitude is kept constant. However, the invention is also applicable to other driving schemes, e.g., based on voltage modulated driving (VM) with a limited number of voltage levels, where the pulse voltage amplitude is varied in each waveform, or combined PWM and VM driving. The invention is applicable to color as well as greyscale bi-stable displays. Also, the electrode structure is not limited. For example, a top/bottom electrode structure (vertical structure), a honeycomb structure, an in-plane switching structure, or other combined in-plane-switching and vertical switching may be used. Moreover, the invention may be implemented in passive matrix as well as active matrix electrophoretic displays. In fact, the invention can be implemented in any bi-stable display that does not consume power while the image substantially remains on the display after an image update. Also, the invention is applicable to both single and multiple window displays, where, for example, a typewriter mode exists.

While there has been shown and described what are considered to be preferred embodiments of the invention, it will, of course, be understood that various modifications and changes in form or detail could readily be made without departing from the spirit of the invention. It is therefore intended that the invention not be limited to the exact forms described and illustrated, but should be construed to cover all modifications that may fall within the scope of the appended claims.

The invention claimed is:

1. A method for updating at least a portion of a bi-stable display in successive frame periods, the method comprising:

accessing data defining at least one voltage waveform for the successive frame periods; and driving the at least a portion of the bi-stable display (310) during the successive frame periods according to the accessed data so that at least one longer frame period (FT) is used during at least a first portion of the voltage waveforms, and at least one shorter frame period (FT') is used during at least a second portion of the voltage waveforms, wherein said longer frame period is used for generating a reset pulse to drive said display to a black state and said shorter frame period is used for a grey scale driving pulse to drive said display to a desired state.

2. The method of claim 1, wherein:

the accessing data defining the at least one voltage waveform comprises accessing data defining a plurality of voltage waveforms.

3. The method of claim 2, wherein:

the driving the at least a portion of the bi-stable display comprises driving the at least a portion of the bi-stable display so that the at least one longer frame period comprises at least one elongated frame period, during which each of the voltage waveforms has a respective constant voltage value.

4. The method of claim 3, wherein:

the driving the at least a portion of the bi-stable display comprises driving the at least a portion of the bi-stable display so that the at least one elongated frame period is the longest period during which each of the voltage waveforms has its respective constant voltage value.

5. The method of claim 3, wherein:

the driving the at least a portion of the bi-stable display comprises driving the at least a portion of the bi-stable display so that the at least one elongated frame period occurs during a reset portion (RE) of the voltage waveforms.

6. The method of claim 3, wherein:

the driving the at least a portion of the bi-stable display comprises driving the at least a portion of the bi-stable display so that the at least one elongated frame period occurs during a drive portion (DR, DR1) of the voltage waveforms.

7. The method of claim 2, wherein:

the driving the at least a portion of the bi-stable display comprises driving the at least a portion of the bi-stable display so that the at least one shorter frame period occurs during at least a terminal portion of a drive portion (DR, DR1) of the voltage waveforms.

8. The method of claim 2, wherein:

the driving the at least a portion of the bi-stable display comprises driving the at least a portion of the bi-stable display so that the at least one shorter frame period occurs during at least a shaking pulse portion (S1) of the voltage waveforms.

9. The method of claim 2, wherein:

the voltage waveforms include at least one rest portion (R, R1, R2) immediately prior to a frame period rate change in the successive frame periods.

10. The method of claim 2, wherein:

each of the voltage waveforms includes first drive portions, and time-aligned second drive portions with a reduced range of voltage values.

11. The method of claim 2, wherein:

each of the voltage waveforms includes a drive portion for providing a direct image transition without reset to an optical rail state; and the driving the at least a portion of the bi-stable display comprises driving the at least a portion of the bi-stable display so that the at least one shorter frame period is used during at least a terminal portion of the drive portion.

12. The method of claim 2, wherein:

the bi-stable display comprises an electrophoretic display.

13. A program storage device tangibly embodying a program of instructions executable by a machine to perform a method for updating at least a portion of a bi-stable display in successive frame periods, the method comprising:

accessing data defining a set of voltage waveforms for the successive frame periods; and driving the at least a portion of the bi-stable display during the successive frame periods according to the accessed data so that at least one longer frame period (FT) is used during at least a first portion of the voltage waveforms, and at least one shorter frame period (FT') is used during at least a second portion of the voltage waveforms, wherein said longer frame period is used for generating a reset pulse to drive said display to a black state and said shorter frame period is used for a grey scale driving pulse to drive said display to a desired state.

14. The program storage device of claim 13, wherein:

the driving the at least a portion of the bi-stable display comprises driving the at least a portion of the bi-stable display so that the at least one longer frame period comprises at least one elongated frame period (1302, 1304, 1402, 1502, 1602, 1702, 1802), during which each of the voltage waveforms has a respective constant voltage value.

15. The program storage device of claim 14, wherein:

the driving the at least a portion of the bi-stable display comprises driving the at least a portion of the bi-stable display so that the at least one elongated frame period is the longest period during which each of the voltage waveforms has its respective constant voltage value.

16. The program storage device of claim 13, wherein:

the bi-stable display comprises an electrophoretic display.

17. An electronic reading device, comprising:

a bi-stable display (310); and a control (100) for updating at least a portion of the bi-stable display in successive frame periods by: (a) accessing data defining a set of voltage waveforms for the successive frame periods, and (b) driving the at least a portion of the bi-stable display (310) during the successive frame periods according to the accessed data so that at least one longer frame period (FT) is used during at least a first portion of the voltage waveforms, and at least one shorter frame period (FT') is used during at least a second portion of the voltage waveforms, wherein said longer frame period is used for generating a reset pulse to drive said display to a black state and said shorter frame period is used for a grey scale driving pulse to drive said display to a desired state.

18. The electronic reading device of claim 17, wherein:

the control drives the at least a portion of the bi-stable display by driving the at least a portion of the bi-stable display so that the at least one longer frame period comprises at least one elongated frame period, during which each of the voltage waveforms has a respective constant voltage value.

19. The electronic reading device of claim 18, wherein:

the control drives the at least a portion of the bi-stable display by driving the at least a portion of the bi-stable display so that the at least one elongated frame period is the longest period during which each of the voltage waveforms has its respective constant voltage value.

20. The electronic reading device of claim 17, wherein:

the bi-stable display comprises an electrophoretic display.

21. A controller (330) comprising a processor and a program of instructions executable by the processor, the program of instructions comprising computer code device means for accessing data defining a set of voltage waveforms for successive frame periods during updating of at least a portion of a bi-stable display (310) and means for driving the at least a portion of the bi-stable display (310) during the successive frame periods according to the accessed data so that at least one longer frame period (FT)is used during at least a first portion of the voltage waveforms, and at least one shorter frame period (FT') is used during at least a second portion of the voltage waveforms, wherein said longer frame period is used for generating a reset pulse to drive said display to a black state and said shorter frame period is used for a grey scale driving pulse to drive said display to a desired state.

* * * * *